US008254795B2

(12) United States Patent
Koizumi et al.

(10) Patent No.: US 8,254,795 B2
(45) Date of Patent: Aug. 28, 2012

(54) SUPPLY CONTROL UNIT AND IMAGE FORMING APPARATUS

(75) Inventors: Eichi Koizumi, Kanagawa (JP); Nobutaka Takeuchi, Kanagawa (JP); Akira Yoshida, Kanagawa (JP); Shinji Kato, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 399 days.

(21) Appl. No.: 12/571,624

(22) Filed: Oct. 1, 2009

(65) Prior Publication Data

US 2010/0086322 A1 Apr. 8, 2010

(30) Foreign Application Priority Data

Oct. 8, 2008 (JP) ..... 2008-261563

(51) Int. Cl.
*G03G 15/08* (2006.01)

(52) U.S. Cl. ..... 399/27; 399/30; 399/49; 399/53; 399/61

(58) Field of Classification Search ..... 399/27, 399/30, 49, 53, 61
See application file for complete search history.

(56) References Cited

U.S. PATENT DOCUMENTS

| | | | | |
|---|---|---|---|---|
| 5,327,196 | A | 7/1994 | Kato et al. | |
| 5,493,382 | A | 2/1996 | Takagaki et al. | |
| 5,671,470 | A | 9/1997 | Maruta et al. | |
| 5,765,059 | A | 6/1998 | Kosuge et al. | |
| 5,970,276 | A | 10/1999 | Kato | |
| 6,081,678 | A | 6/2000 | Kato | |
| 6,366,751 | B1 | 4/2002 | Shakuto et al. | |
| 6,597,881 | B2 | 7/2003 | Hatori et al. | |
| 6,665,511 | B2 | 12/2003 | Takeuchi et al. | |
| 6,757,509 | B2 | 6/2004 | Shoji et al. | |
| 6,819,901 | B1 | 11/2004 | Yasutomi et al. | |
| 6,823,163 | B2 | 11/2004 | Sugimoto et al. | |
| 6,856,780 | B2 | 2/2005 | Kadota et al. | |
| 7,024,141 | B2 | 4/2006 | Takeuchi et al. | |
| 7,103,305 | B2 | 9/2006 | Koike et al. | |
| 7,116,932 | B2 | 10/2006 | Takeuchi et al. | |
| 7,171,145 | B2 | 1/2007 | Takeuchi et al. | |
| 7,245,861 | B2 | 7/2007 | Koike et al. | |
| 7,346,286 | B2 | 3/2008 | Matsumoto et al. | |
| 7,444,107 | B2 | 10/2008 | Takeuchi et al. | |
| 7,493,058 | B2 | 2/2009 | Takeuchi et al. | |
| 7,509,060 | B2 * | 3/2009 | Yaguchi et al. | 399/15 |
| 7,512,364 | B2 | 3/2009 | Muramatsu et al. | |
| 7,536,121 | B2 | 5/2009 | Shimizu et al. | |
| 7,551,862 | B2 | 6/2009 | Tanaka et al. | |
| 8,009,997 | B2 * | 8/2011 | Ariizumi et al. | 399/27 |

(Continued)

FOREIGN PATENT DOCUMENTS

| | | | |
|---|---|---|---|
| JP | 2535965 | | 7/1996 |
| JP | 9-160364 | | 6/1997 |
| JP | 2001197297 A | * | 7/2001 |
| JP | 2008-65054 | | 3/2008 |

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A supply control unit is configured to, in a successive image-forming operation, perform a process of successively generating a driving control pattern for a toner supply device based on image information of each page, and synthesizing an unused portion of the driving control pattern which is obtained by eliminating a portion of the driving control pattern already reflected on a driving control of the toner supply device from the driving control pattern generated based on image information of a previous page with a driving control pattern generated based on a subsequent page.

10 Claims, 22 Drawing Sheets

U.S. PATENT DOCUMENTS

2001/0017991 A1* 8/2001 Kobayashi et al. ..... 399/61
2006/0127109 A1* 6/2006 Itoyama et al. ..... 399/27
2007/0110457 A1 5/2007 Kato et al.
2007/0248368 A1 10/2007 Kato et al.
2008/0019712 A1* 1/2008 Tanaka et al. ..... 399/30
2008/0069580 A1 3/2008 Oshige et al.
2008/0075482 A1* 3/2008 Hirota ..... 399/30
2008/0273885 A1* 11/2008 Koizumi et al. ..... 399/30
2009/0041520 A1 2/2009 Takeuchi et al.
2009/0116861 A1 5/2009 Oshige et al.

* cited by examiner

A4 LANDSCAPE PRINTING
<PAPER SIZE A>

SUPPLY CONTROL UNIT AND IMAGE FORMING APPARATUS

CROSS-REFERENCE TO RELATED APPLICATIONS

The present application claims priority to and incorporates by reference the entire contents of Japanese Patent Application No. 2008-261563 filed in Japan on Oct. 8, 2008.

BACKGROUND OF THE INVENTION

1. Field of the Invention

The present invention relates to an image forming apparatus that uses a developing unit with a configuration that enables a developer fed along a predetermined circulation path to be carried on a moving surface of a developer carrying member to be used for development, and then returned from the surface of the developer carrying member to the circulation path.

2. Description of the Related Art

A developing device described in Japanese Patent Application Laid-open No. H9-160364 is known as one type of developing units related to the present invention. FIG. 1 depicts this developing device. As shown in FIG. 1, a developing device 900 includes a circulation path for circulatingly feeding a developer (not shown) that contains toner and magnetic carrier within a casing, a development roll 910, and the like. The circulation path includes a first developer containing chamber 901 and a second developer containing chamber 903, which are arranged side by side in a lateral direction. A developer contained in the first developer containing chamber 901, which is a part of the circulation path, is fed in the chamber space along a longitudinal direction by rotational driving of a first feed screw 902 in a direction of an arrow A in FIG. 1. The first developer containing chamber 901 and the second developer containing chamber 903 adjacent to each other are communicated at both ends thereof in the longitudinal direction. The developer fed to the end of the first developer containing chamber 901 in the direction of the arrow A in FIG. 1 with the rotational driving of the first feed screw 902 enters the second developer containing chamber 903 through a communication portion. The developer is fed in the second developer containing chamber 903 by rotational driving of a second feed screw 904 in a direction of an arrow B completely opposite to that of the arrow A. When the developer is fed to the end in the second developer containing chamber 903 in the direction of the arrow B, the developer enters most upstream of the first developer containing chamber 901 in the direction of the arrow A through a communication portion. In this way, the developer is circulatingly fed in the first and second developer containing chambers 901 and 903.

The development roll 910 is placed on a lateral side of the second developer containing chamber 903. The development roll 910 includes a development sleeve including a nonmagnetic pipe that is rotationally driven, and a magnet roller (not shown) that is unrotatably housed inside the development sleeve. The developer in the second developer containing chamber 903 is carried on the surface of the rotating development sleeve by a magnetic force produced by the magnet roller and fed to a development area in which the development sleeve and a photoconductor (not shown) face with each other. The surface of the sleeve is then developed with the developer, and the developer on the sleeve surface is returned to the second developer containing chamber 903. The toner concentration is reduced because the developer contributes to the development. A control unit (not shown) estimates an amount of toner consumed during the development of an image based on a result of calculation of the number of pixels in the image based on image information, and drives a toner supplying unit (not shown) for a time corresponding to a result of the estimation. In this way, supplemental toner is added to the toner in the first developer containing chamber 901 through a toner supply opening 915 located near an upstream end in a direction of developer feeding in the first developer containing chamber 901, thereby restoring the toner concentration of the developer. This toner supply enables to restore the toner concentration more promptly than in a configuration in which toner supply is performed after a toner concentration sensor detects a reduction in the toner concentration of a developer.

However, in a successive image-forming operation in which images are successively output onto plural sheets of recording paper, when image area ratios of the pages are greatly different from each other, it is difficult to stabilize the toner concentration of the developer for a reason explained below. That is, in the first developer containing chamber 901 that contains the developer being fed and not drawn up by the development roll 910, fluctuation in the toner concentration resulting from toner consumption associated with the development starts quite later than the consumption. When an image corresponding to one page is output for example, most of the developer used for the development of the image still remains in the second developer containing chamber 903 immediately after the output of the image. With subsequent rotation of the second feed screw 904, the development enters the first developer containing chamber 901 little by little, which gradually reduces the toner concentration of the developer in the first developer containing chamber 901. It takes a relatively long time that most of the developer used for the development in the development area has entered the first developer containing chamber 901. It means that the fluctuation in the toner concentration of the developer in the first developer containing chamber 901 due to the output of the image corresponding to one page continues for a long time. Nevertheless, an operation of supplying the toner corresponding to an amount of consumption for one page is performed for a short time. It implies that, immediately after a page with a high image area ratio is output, a large amount of toner is supplied to the first developer containing chamber 901 before the toner concentration of the developer therein is sufficiently reduced. This causes the toner concentration of the developer in the first developer containing chamber 901 to be higher than desired. When a page with a low image area ratio is then output, the developer with the toner concentration greatly reduced by the output of the previous page is drawn from the second developer containing chamber 903 to the first developer containing chamber 901 although only a small amount of toner is supplied to the first developer containing chamber 901. This causes the toner concentration of the developer in the first developer containing chamber 901 to be lower than desired. As a result, it becomes difficult to stabilize the toner concentration of the developer.

SUMMARY OF THE INVENTION

It is an object of the present invention to at least partially solve the problems in the conventional technology.

According to one aspect of the present invention, there is provided an image forming apparatus including: a latent-image carrying member on which a latent image is formed; an image-information obtaining unit that obtains image information; a latent-image forming unit that forms the latent image on the latent-image carrying member based on the image information; a developing unit that develops the latent image by causing a toner to adhere to the latent image on the latent-image carrying member in a development area, which is an area in which a developer carrying member and the latent-image carrying member face with each other, by conveying a developer, which contains the toner and a carrier, included in a supply area that is an area facing the developer carrying member in a predetermined circulation path to the development area by carrying the developer on a moving surface of the developer carrying member while conveying the developer along the circulation path, and returns the developer used for the development in the development area to the supply area with a surface movement of the developer carrying member; a toner supplying unit that supplies the toner to a non-supply area that is an area different from the supply area in the circulation path through a toner supply opening provided at a predetermined position in the non-supply area; and a control unit that controls an amount of supplying the toner by controlling driving of the toner supplying unit based on the image information. The controller is configured to, in a successive image-forming operation in which driving control patterns for the toner supplying unit that are patterns of toner supply amount fluctuation canceling toner concentration fluctuation expected to occur in the developer that has passed through the supply area are generated based on the image information, driving of the toner supplying unit is controlled based on the driving control patterns, and image forming operations for plural pages are successively performed, perform a process of successively generating the driving control pattern for each of the pages based on the image information and synthesizing an unused portion of the driving control pattern generated based on the image information of a previous page, that is obtained by eliminating a portion already reflected on the driving control for the toner supplying unit from the driving control pattern generated based on the previous page, with a driving control pattern generated based on a subsequent page, or, in the successive image-forming operation, perform a process of converting the toner-supply-amount fluctuation pattern generated based on the image information of the previous page into the driving control pattern to be used for the driving control of the toner supplying unit, synthesizing a portion of the toner-supply-amount fluctuation pattern of the previous page unconverted into the driving control pattern with the toner-supply-amount fluctuation pattern generated based on the subsequent image information, and converting a synthesized toner-supply-amount fluctuation pattern into the driving control pattern to be used for the driving control of the toner supplying unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplarily embodiments of the present invention will be explained below, which are applied to an electrophotographic printer (hereinafter, simply "printer") as an image forming apparatus.

A basic configuration of the printer according to the present embodiment is explained.

Figure 1:
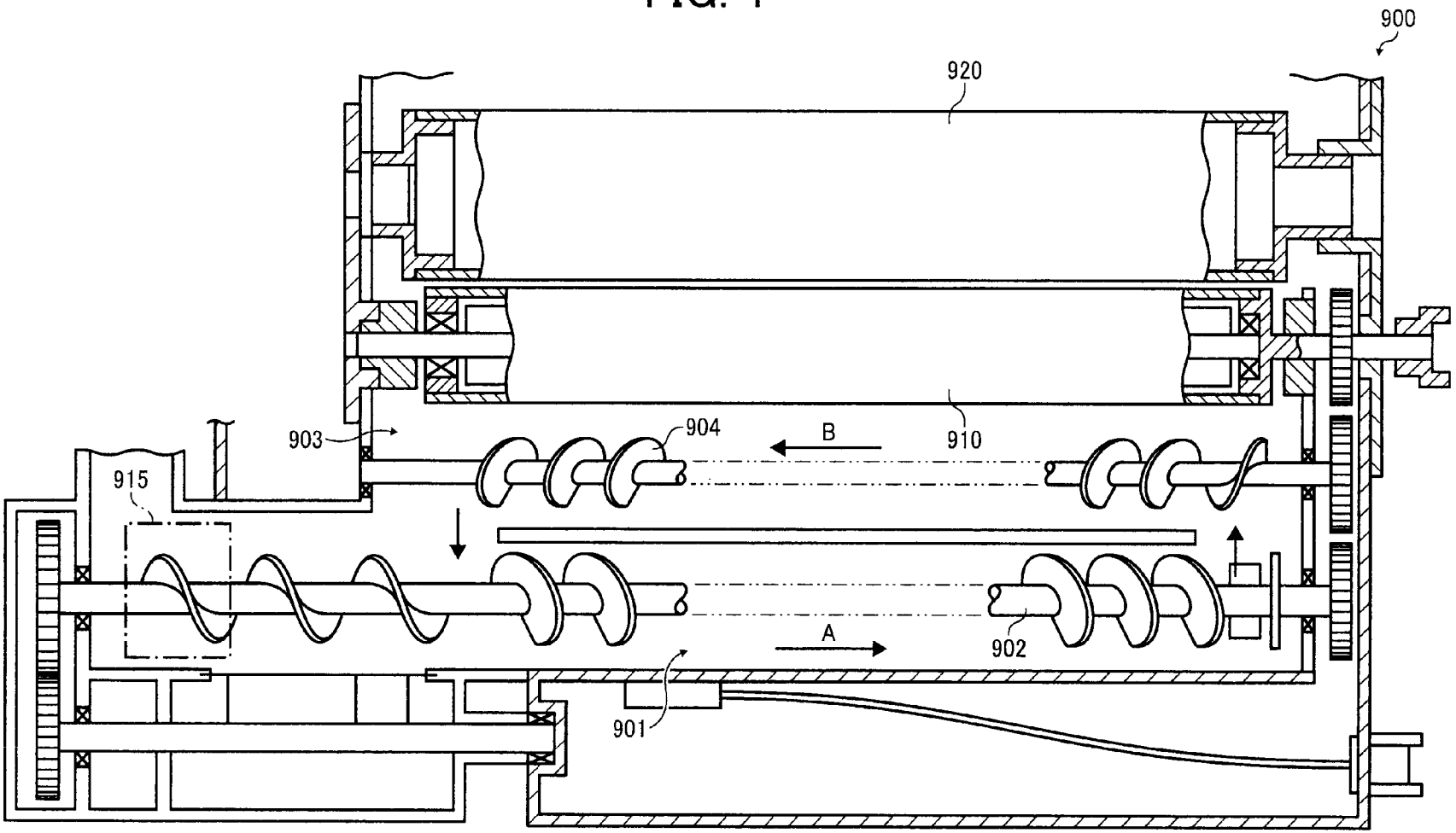
FIG. 1 is a schematic configuration diagram of a development device described in Japanese Patent Application Laid-open No. H9-160364.
Figure 2:
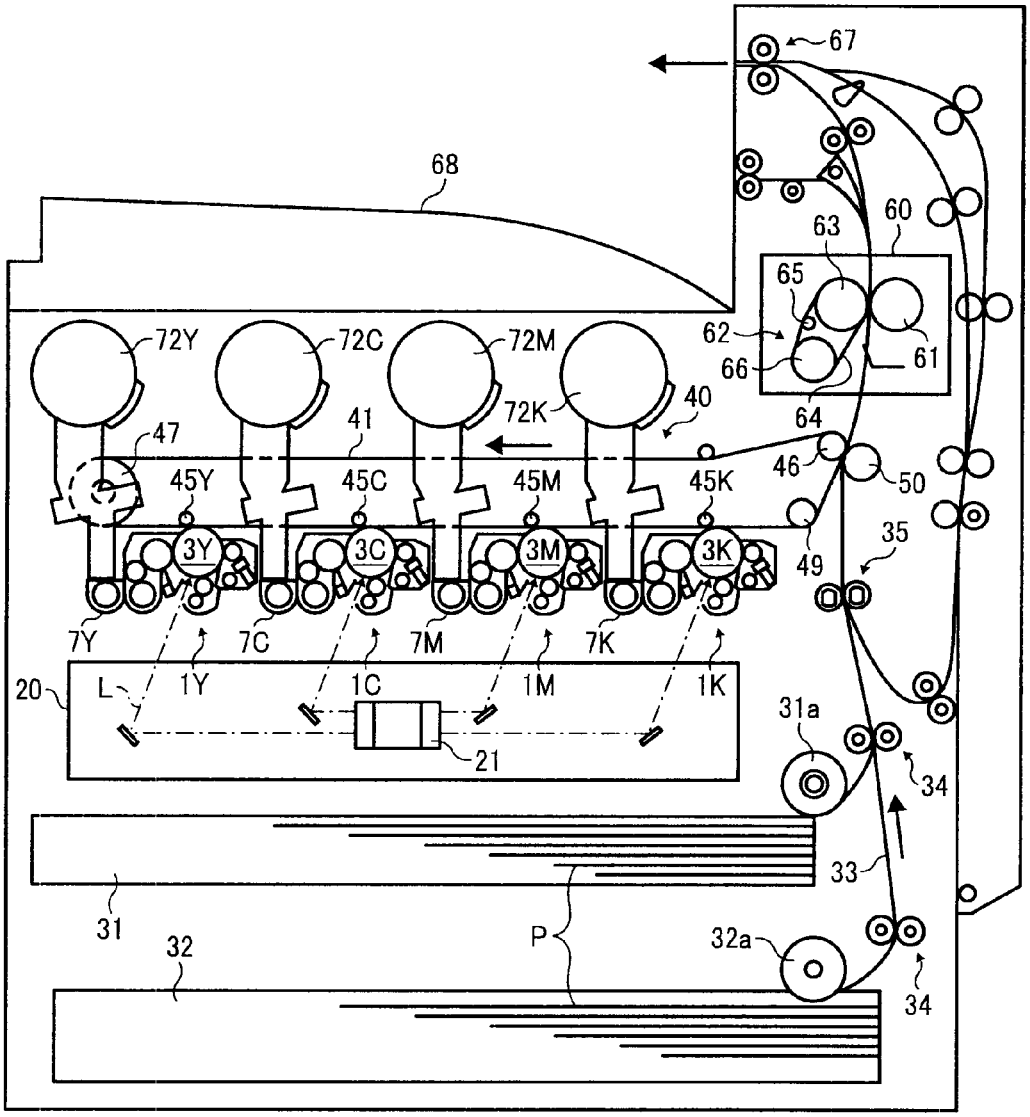
FIG. 2 is a schematic configuration diagram of a printer according to an embodiment of the present invention.

FIG. 2 is a schematic configuration diagram of the printer according to the present embodiment. This printer includes four process units 1Y, 1C, 1M, and 1K for yellow, cyan, magenta, and black (hereinafter, Y, C, M, and K), respectively. These process units use Y, C, M, and K toner of different colors as image formation materials for forming images, and other configurations thereof are the same.

Figure 3:
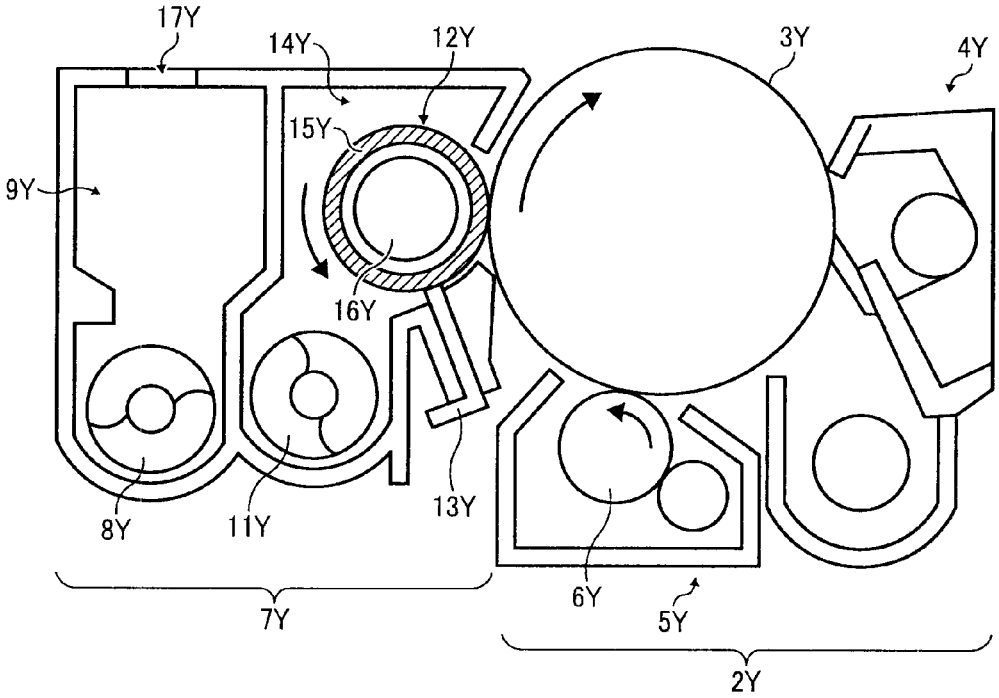
FIG. 3 is an enlarged schematic diagram of a configuration of a process unit for generating Y toner images in the printer.
Figure 4:
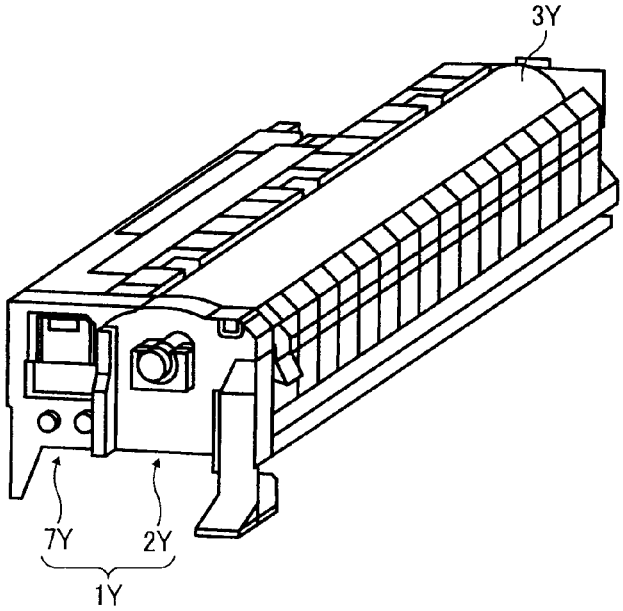
FIG. 4 is a perspective view of an external appearance of the process unit.

FIG. 3 is a schematic diagram of a configuration of the process unit 1Y for generating Y toner images. FIG. 4 is a perspective view of an outer appearance of the process unit 1Y. As shown in FIGS. 3 and 4, the process unit 1Y includes a photoconductor unit 2Y and a developing unit 7Y. The photoconductor unit 2Y and the developing unit 7Y are configured as the process unit 1Y capable of being integrally attached to or detached from a printer body, as shown in FIG. 4. In a state detached from the printer body, the developing unit 7Y can be attached to or detached from a photoconductor unit (not shown).

The photoconductor unit 2Y includes a photoconductor 3Y in the form of a drum as a latent-image carrying member, a drum cleaning device 4Y, an electrostatic eliminator (not shown), a charging device 5Y, and the like. The charging device 5Y as a charging unit uniformly charges the surface of the photoconductor 3Y rotationally driven in a clockwise direction in FIG. 3 by a driving unit (not shown), by using a charging roller 6Y. Specifically, the photoconductor 3Y is uniformly charged by applying a charging bias from a power source (not shown) to the charging roller 6Y rotationally driven in a counterclockwise direction in FIG. 3, and bringing the charging roller 6Y close to or in contact with the photoconductor 3Y. The charging device 5Y can use another charging member such as a charging brush, instead of the charging roller, and brings the member close to or in contact with the photoconductor 3Y. A scorotoron charger that uniformly charges the photoconductor 3Y in a charger system can be also used. The surface of the photoconductor 3Y, uniformly charged by the charging device 5Y, is exposed and scanned by laser light emitted from a light writing unit 20 serving as a latent-image forming unit described later, and carries a Y electrostatic latent image.

Figure 5:
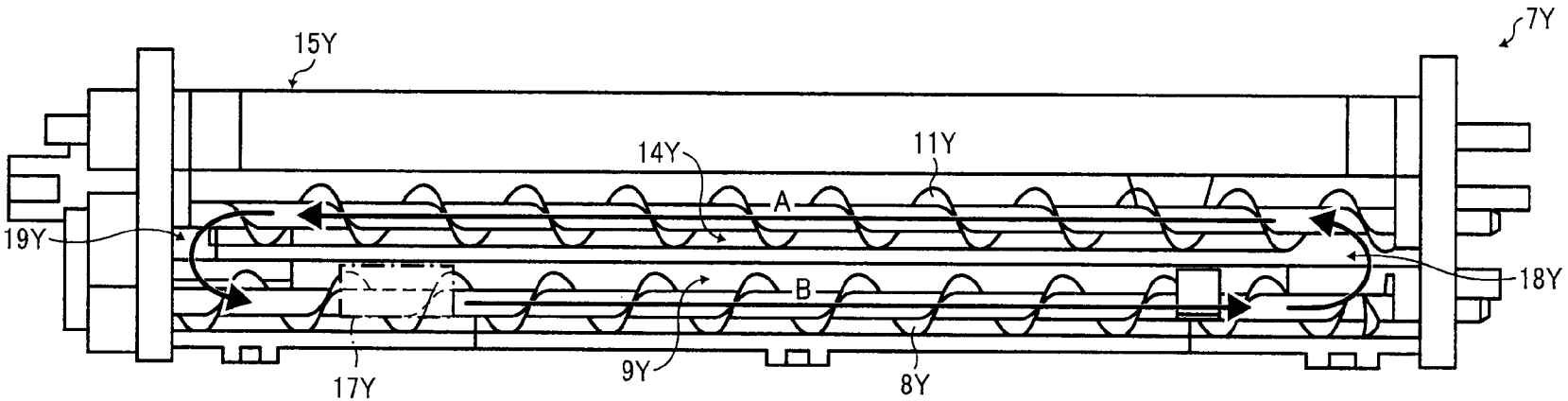
FIG. 5 is an exploded plan view of a developing unit of the process unit.

FIG. 5 is an exploded configuration diagram of the developing unit 7Y. The developing unit 7Y includes a first developer containing chamber 9Y having a first feed screw 8Y as a developer feeding unit arranged therein, as shown in FIGS. 3 and 5. The developing unit 7Y also includes a second developer containing chamber 14Y having a second feed screw 11Y as a developer feeding unit, a development roll 12Y as a developer carrying member, a doctor blade 13Y as a developer regulating member, and the like, arranged therein. These two developer containing chambers forming a circulation path contain Y developer (not shown), which is a binary developer including magnetic carrier and negatively-charged Y toner. The first feed screw 8Y is rotationally driven by a driving unit (not shown) to feed the Y developer in the first developer containing chamber 9Y toward the front side in FIG. 3 (in a direction of an arrow A in FIG. 5). The Y developer fed to the end of the first developer containing chamber 9Y by the first feed screw 8Y enters the second developer containing chamber 14Y through a communication opening 18Y.

The second feed screw 11Y in the second developer containing chamber 14Y is rotationally driven by a driving unit (not shown) to feed the Y developer to the back side in FIG. 3 (in the direction of the arrow A in FIG. 5). The development roll 12Y is placed above the second feed screw 11Y that feeds the Y developer in this way in FIG. 3, in parallel with the second feed screw 11Y. The development roll 12Y includes therein a magnet roller 16Y fixedly placed in a development sleeve 15Y made of a nonmagnetic sleeve that is rotationally driven in a counterclockwise direction in FIG. 3. A part of the Y developer fed by the second feed screw 11Y is drawn up to the surface of the development sleeve 15Y by a magnetic force produced by the magnet roller 16Y. The doctor blade 13Y placed to keep a predetermined distance from the surface of the development sleeve 15Y regulates a thickness of the developer. The developer is then fed to a development area facing the photoconductor 3Y, and the Y toner is caused to adhere to the Y electrostatic latent image on the photoconductor 3Y. This adhesion forms a Y toner image on the photoconductor 3Y. The Y developer having the Y toner consumed by the development is returned to the second feed screw 11Y with rotation of the development sleeve 15Y. The Y developer fed to the end of the second developer containing chamber 14Y by the second feed screw 11Y returns to the first developer containing chamber 9Y through a communication opening 19Y. In this way, the Y developer is circulatingly fed in the developing unit.

Figure 6:
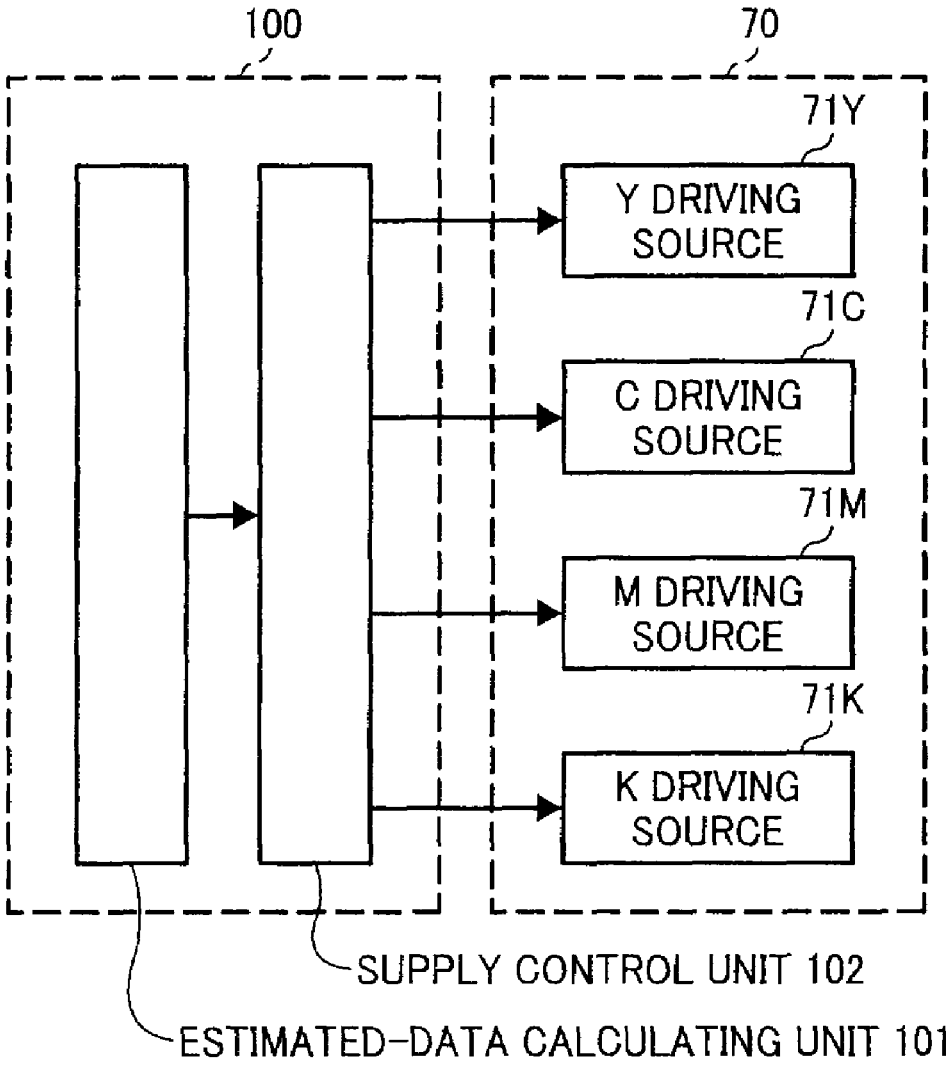
FIG. 6 is a block diagram of a part of an electric circuit of the printer.

FIG. 6 is a block diagram of a part of an electric circuit of the printer. A control unit 100 shown in FIG. 6 includes a central processing unit (CPU) as a computing unit, a random access memory (RAM) and a read only memory (ROM) as data storage units, and the like, and can execute various types of computing processes or control programs. In FIG. 2, the Y toner image formed on the photoconductor 3Y is intermediately transferred on an intermediate transfer belt 41 as an intermediate transfer body. The drum cleaning device 4Y of the photoconductor unit 2Y removes toner remaining on the surface of the photoconductor 3Y subjected to the intermediate transfer process. Electrostatic on the surface of the photoconductor 3Y cleaned in this way is eliminated by the electrostatic eliminator (not shown). This electrostatic elimination initializes the surface of the photoconductor 3Y for a subsequent image formation. Also in the process units 1C, 1M, and 1K for other colors, C, M, and K toner images are formed on the photoconductors 3C, 3M, and 3K and intermediately transferred on the intermediate transfer belt 41 in the same manner, respectively.

The light writing unit 20 is located below the process units 1Y, 1C, 1M, and 1K in FIG. 2. The light writing unit 20 applies laser light L emitted based on image information to the corresponding photoconductors 3Y, 3C, 3M, and 3K of the process units 1Y, 1C, 1M, and 1K. This forms Y, C, M, and K electrostatic latent images on the photoconductors 3Y, 3C, 3M, and 3K, respectively. The light writing unit 20 deflects the laser light L emitted from a light source by using a polygon mirror 21 rotationally driven by a motor, and applies the deflected light L to the photoconductors 3Y, 3C, 3M, and 3K thorough plural optical lens and mirrors. Instead of this configuration, the light writing unit 20 can use a light-emitting diode (LED) array.

A first paper cassette 31 and a second paper cassette 32 are placed below the light writing unit 20, vertically superposed. Each of the paper cassettes contains plural sheets of recording paper P as recording materials in a state of a stack of recording paper. A first feed roller 31*a* and a second feed roller 32*a* abut on the top sheets of recording paper P, respectively. When the first feed roller 31*a* is rotationally driven by a driving unit (not shown) in a counterclockwise direction in FIG. 2, the top sheet of recording paper P in the first paper cassette 31 is ejected toward a feed path 33 arranged to vertically extend on the right side of the cassette in FIG. 2. When the second feed roller 32*a* is rotationally driven by a driving unit (not shown) in a counterclockwise direction in FIG. 2, the top sheet of recording paper P in the second paper cassette 32 is ejected toward the feed path 33. A plurality of feed roller pairs 34 is arranged in the feed path 33. The recording paper P fed into the feed path 33 is fed through the feed path 33 from a lower portion to an upper portion in FIG. 2 with being sandwiched by rollers of the feed roller pairs 34. A registration roller pair 35 is placed at an end of the feed path 33. Upon sandwiching in the recording paper P fed by the feed roller pairs 34 between rollers, the registration roller pair 35 temporarily stops rotation of the both rollers. The registration roller pair 35 then sends the recording paper P toward a secondary transfer nip (described later) in an appropriate timing.

A transfer unit 40 that tightly extend and endlessly moves the intermediate transfer belt 41 in the counterclockwise direction in FIG. 2 is placed above the process units 1Y, 1C, 1M, and 1K in FIG. 2. The transfer unit 40 includes a belt cleaning unit 42, a first bracket 43, and a second bracket 44, in addition to the intermediate transfer belt 41. The transfer unit 40 further includes four primary transfer rollers 45Y, 45C, 45M, and 45K, a secondary-transfer backup roller 46, a driving roller 47, an auxiliary roller 48, and a tension roller 49. With tightly extended by these rollers, the intermediate transfer belt 41 is endlessly moved in the counterclockwise direction in FIG. 2 by rotational driving of the driving roller 47. The four primary transfer rollers 45Y, 45C, 45M, and 45K nip the intermediate transfer belt 41 that endlessly moves in this way with the photoconductors 3Y, 3C, 3M, and 3K, thereby each forming a primary transfer nip. A transfer bias of opposite polarity to that of the toner, or positive polarity in the present embodiment is applied to the inner circumferential surface of the intermediate transfer belt 41. The intermediate transfer belt 41 is subjected to primary transfer while it successively passes through the Y, C, M, and K primary transfer nips with its endless movement so that toner images of the respective colors on the photoconductor 3Y, 3C, 3M, and 3K are superimposed one after another on the outer circumferential surface of the intermediate transfer belt 41. In this way, a four-color superimposed toner image (hereinafter, "four-color toner image") is formed on the intermediate transfer belt 41.

The secondary-transfer backup roller 46 nips the intermediate transfer belt 41 with a secondary transfer roller 50 placed outside of the loop of the intermediate transfer belt 41, thereby forming a secondary transfer nip. The registration roller pair 35 described above sends the recording paper P sandwiched between rollers toward the secondary transfer nip in such a timing that the recording paper P can be synchronized with the four-color toner image on the intermediate transfer belt 41. The four-color toner image on the intermediate transfer belt 41 is secondarily transferred in a lump on the recording paper P within the secondary transfer nip due to a secondary-transfer electric field formed between the secondary transfer roller 50 applied with a secondary transfer bias and the secondary-transfer backup roller 46, and a nip pressure. The four-color toner image combines with a white color of the recording paper P, resulting in a full-color toner image.

Untransferred toner that has not been transferred onto the recording paper P is adhered to the intermediate transfer belt 41 that has passed through the secondary transfer nip. The residual toner is cleaned by the belt cleaning unit 42. The belt cleaning unit 42 causes a cleaning blade 42*a* to abut on the front surface of the intermediate transfer belt 41, thereby scraping the untransferred toner off the belt.

The first bracket 43 of the transfer unit 40 is rocked about a rotation axis of the auxiliary roller 48 at a predetermined rotational angle by turning a solenoid (not shown) on or off. When a monochrome image is to be formed, the printer according to the present embodiment rotates the first bracket 43 a little in the counterclockwise direction in FIG. 2 by driving the solenoid. This rotation causes the Y, C, and M primary transfer rollers 45Y, 45C, and 45M to revolve in the counterclockwise direction in FIG. 2 about the rotation axis of the auxiliary roller 48, thereby separating the intermediate transfer belt 41 from the Y, C, and M photoconductors 3Y, 3C, and 3M. Only the process unit 1K for K among the four process units 1Y, 1C, 1M, and 1K is then driven to form the monochrome image. Accordingly, wasting of the Y, C, and M process units due to unnecessary driving of these process units during the formation of the monochrome image can be avoided.

A fixing unit 60 is placed above the secondary transfer nip in FIG. 2. The fixing unit 60 includes a pressure and heat roller 61 including therein a heat source such as a halogen lamp, and a fixing belt unit 62. The fixing belt unit 62 includes a fixing belt 64, a heat roller 63 including therein a heat source such as a halogen lamp, a tension roller 65, a driving roller 66, a temperature sensor (not shown), and the like. The endless fixing belt 64 is tightly extended and endlessly moved in the counterclockwise direction FIG. 2 by the heat roller 63, the tension roller 65, and the driving roller 66. The fixing belt 64 is heated from the back side by the heat roller 63 in the course of the endless movement. The pressure and heat roller 61 rotationally driven in the counterclockwise direction in FIG. 2 abuts on the front surface of the fixing belt 64 at a position where the fixing belt 64 heated in the manner above mentioned is hung around the heat roller 63. In this way, a fixing nip where the pressure and heat roller 61 and the fixing belt 64 abut on each other is formed.

The temperature sensor (not shown) is placed outside of the loop of the fixing belt 64 to face the front surface of the fixing belt 64 with a predetermined gap therebetween, and senses a surface temperature of the fixing belt 64 immediately before an entry into the fixing nip. A result of the sensing is sent to a fixing power circuit (not shown). The fixing power circuit controls power supply to the heat source included in the heat roller 63 or the heat source included in the pressure and heat roller 61 based on a result of the sensing by the temperature sensor to switch on or off. In this way, the surface temperature of the fixing belt 64 is kept at about 140° C. The recording paper P passed through the secondary transfer nip is separated from the intermediate transfer belt 41 and then fed into the fixing unit 60. The recording paper P is heated and pressured by the fixing belt 64 in the course of feeding from a lower portion to an upper portion in FIG. 2 with being nipped by the fixing nip in the fixing unit 60. Accordingly, a full-color toner image is fixed on the recording paper P.

The recording paper P subjected to the fixing process is passed through between rollers of an ejecting roller pair 67 and then ejected outside the printer. A stack unit 68 is formed on the top face of an enclosure of the printer body, and the recording paper P ejected outside the printer by the ejecting roller pair 67 is successively stacked on the stack unit 68.

Toner bottles 72Y, 72C, 72M, and 72K, which are four toner containers that contain Y, C, M, and K toner, respectively, are placed above the transfer unit 40. Toner of respective colors in the toner bottles 72Y, 72C, 72M, and 72K is properly supplied by a toner supply device 70 to the developing units 7Y, 7C, 7M, and 7K of the process units 1Y, 1C, 1M, and 1K, respectively. The toner bottles 72Y, 72C, 72M, and 72K can be attached to or detached from the printer body independently of the process units 1Y, 1C, 1M, and 1K.

Figure 7:
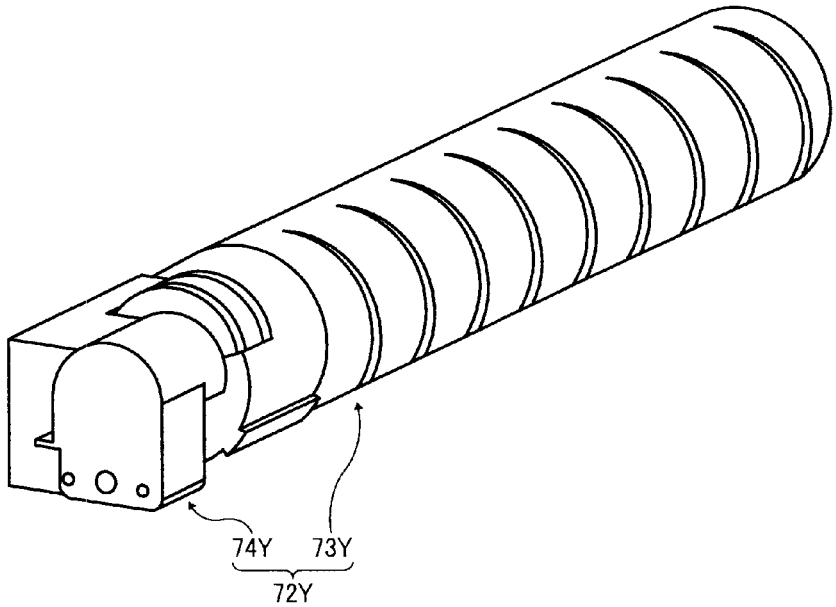
FIG. 7 is a perspective view of a Y toner bottle.
Figure 8:
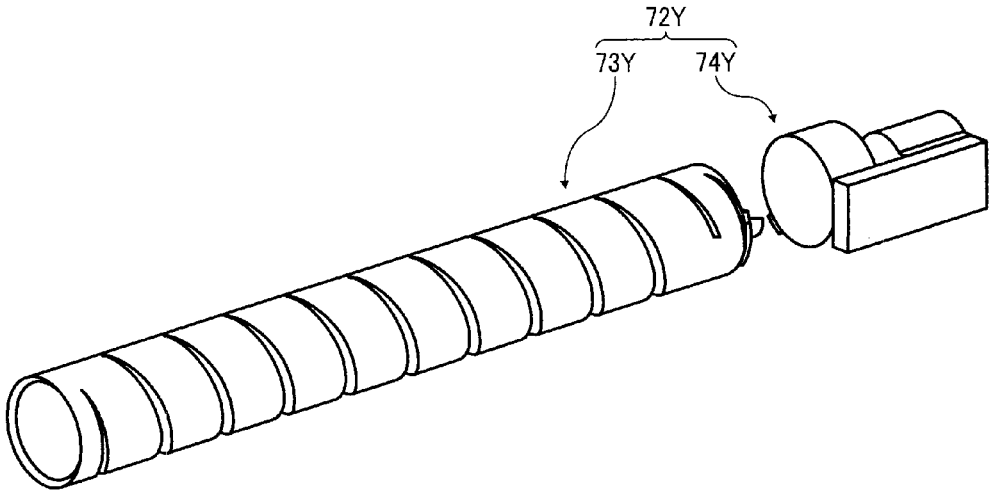
FIG. 8 is a perspective view of the toner bottle disassembled into a bottle unit and a holder unit.

FIG. 7 is a perspective view of the Y toner bottle 72Y. As shown in FIG. 7, the Y toner bottle 72Y includes a bottle unit 73Y in the form of a bottle, which is a powder containing unit that contains the Y toner (not shown) as powder, and a cylindrical holder unit 74Y, which is a powder discharging unit. The holder unit 74Y engages with the head of the bottle unit 73Y in the form of a bottle to rotatably hold the bottle unit 73Y, as shown in FIG. 8. A spiral projection in the form of a screw projecting from outside to inside of the container is formed on the inner circumferential surface of the bottle unit 73Y to extend in the direction of the axis of the bottle.

Figure 9:
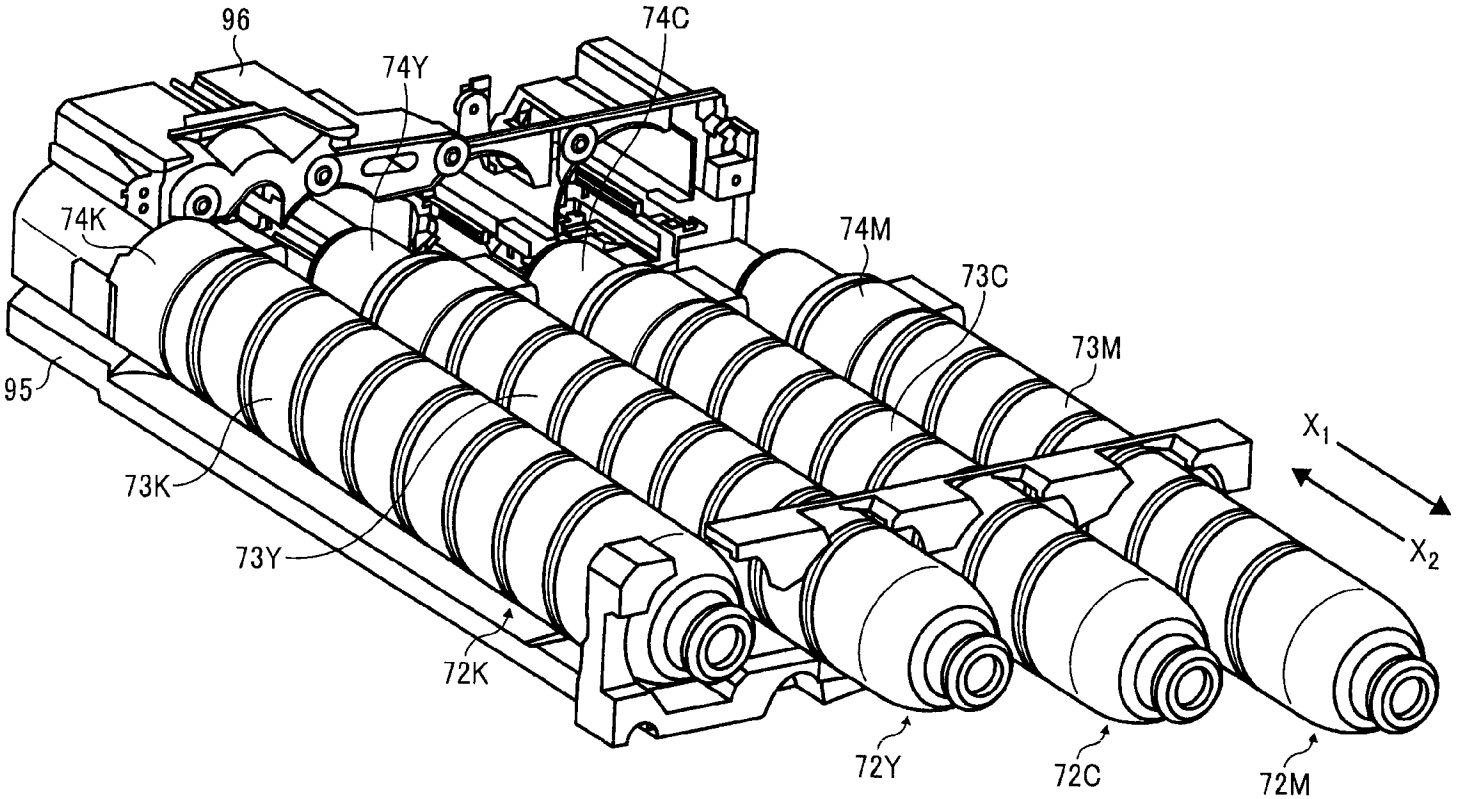
FIG. 9 is a perspective view of a toner supply device of the printer.

FIG. 9 is a perspective view of the toner supply device 70 of the printer according to the present embodiment. As shown in FIG. 9, the toner supply device 70 as a toner supplying unit includes a bottle mount 95 on which the four toner bottles 72K, 72Y, 72C, and 72M are mounted, a bottle driving unit 96 that rotationally drives the respective bottle units individually, and the like. The toner bottles 72K, 72Y, 72C, and 72K set on the bottle mount 95 have the respective holder units engaged with the bottle driving unit 96. When the toner bottle 72M engaged with the bottle driving unit 96 is slid on the bottle mount 95 in a direction away from the bottle driving unit 96 as indicated by an arrow $X_1$ in FIG. 9, the holder unit 74M of the toner bottle 72M is detached from the bottle driving unit 96. In this way, the toner bottle 72M can be removed from the toner supply device 70. When the toner bottle 72M is slid on the bottle mount 95 in the toner supply device 70 without the toner bottle 72M attached thereto in a direction toward the bottle driving unit 96 as indicated by an arrow $X_2$ in FIG. 9, the holder unit 74M of the toner bottle 72M engages with the bottle driving unit 96. In this way, the toner bottle 72M can be attached to the toner supply device 70. The toner bottles 72K, 72Y, and 72C for other colors can be detached from or attached to the toner supply device 70 in the same operations.

A gear unit (not shown) is formed on the outer circumferential surface at the head of each of the bottle units 73K, 73Y, 73C, and 73M of the toner bottles 72K, 72Y, 72C, and 72M, respectively. These gear units are covered over by the holder units 74K, 74Y, 74C, and 74M. A notch (not shown) is formed at a part of the circumferential surface of each of the holder units 74K, 74Y, 74C, and 74M to partially expose the gear unit, and the gear unit partially exposes itself through the notch. When the holder units 74K, 74Y, 74C, and 74M of the toner bottles 72K, 72Y, 72C, and 72M engage with the bottle driving unit 96, K, Y, C, and M bottle driving gears (not shown) included in the bottle driving unit 96 engage with the gear units of the bottle units 73K, 73Y, 73C, and 73M through the corresponding notches. The K, Y, C, and M bottle driving gears of the bottle driving unit 96 are rotationally driven by a driving system (not shown), so that the bottle units 73K, 73Y, 73C, and 73M are rotationally driven on the holder units 74K, 74Y, 74C, and 74M.

When the bottle unit 73Y is rotated on the holder unit 74Y in this way in FIG. 7, the Y toner in the bottle unit 73Y is moved from the bottom of the bottle toward the head of the bottle along the spiral projection in the form of a screw. The Y toner then enters the cylindrical holder unit 74Y through a bottle opening (not shown) at the tip of the bottle unit 73Y as the container containing the powder.

Figure 10:
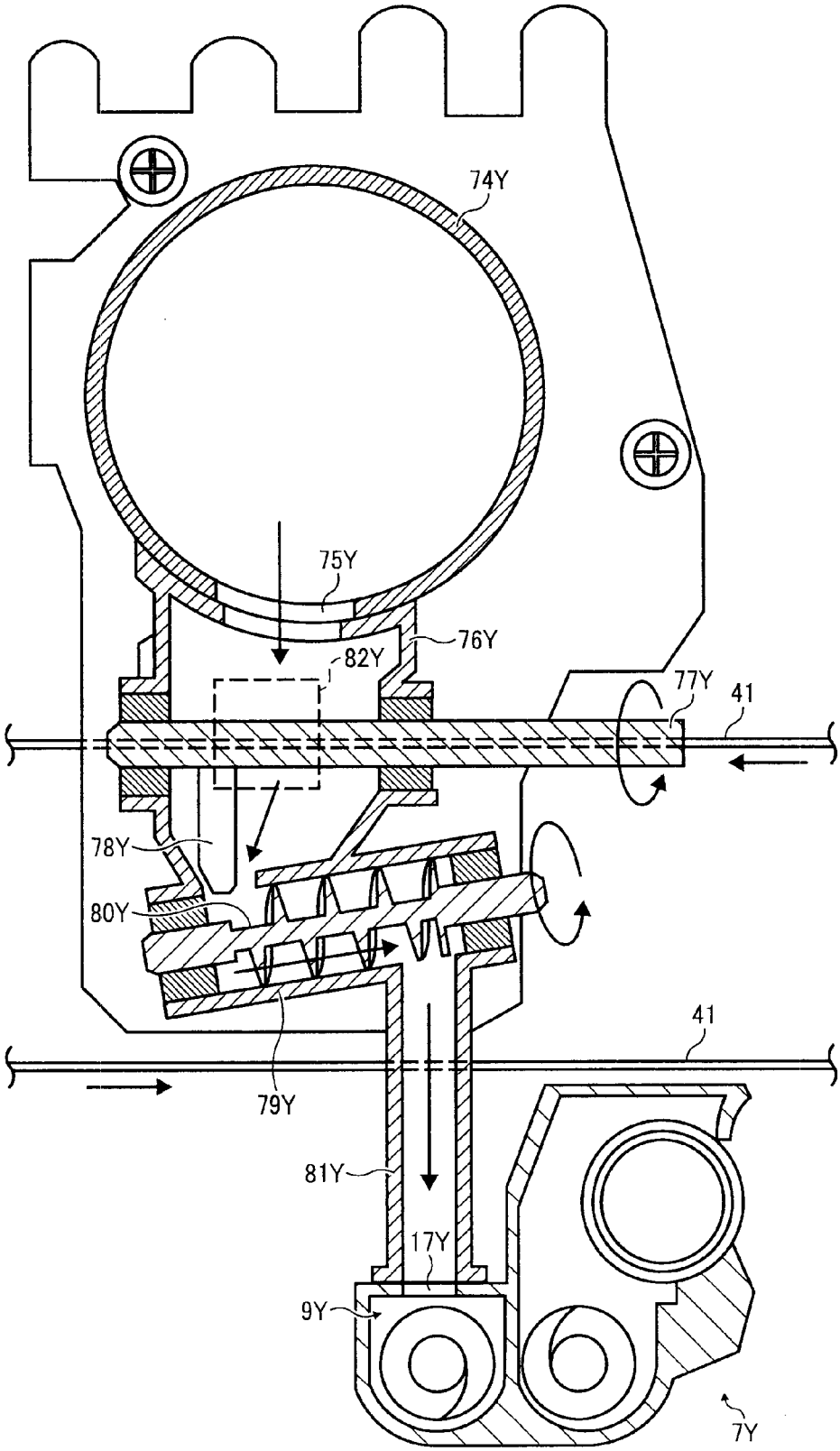
FIG. 10 is a schematic configuration diagram of a toner bottle attached to the toner supply device and peripheral components.

FIG. 10 is a schematic configuration diagram of the toner bottle attached to the toner supply device (not shown), and peripheral components. FIG. 10 depicts a horizontal section of the toner bottle taken at the position of the holder unit 74Y. As described above, the Y toner in the bottle unit (not shown), which is located on the back side with respect to the holder unit 74Y in FIG. 10, is fed into the holder unit 74Y by the rotational driving of the bottle unit. The holder unit 74Y of the toner bottle engages with a hopper unit 76Y of the toner supply device. The hopper unit 76Y is formed into a shape flattened in a direction orthogonal to the paper plane of FIG. 10, and located in front of the intermediate transfer belt 41 in FIG. 10. A toner discharging opening 75Y formed at the bottom of the holder unit 74Y and a toner receiving opening formed in the hopper unit 76Y of the toner supply device communicate with each other. The Y toner fed from the bottle unit of the toner bottle to the holder unit 74Y drops into the hopper unit 76Y under its own weight. A flexible pressing film 78Y fixed on a rotatable rotation axis member 77Y rotates with the rotation axis member 77Y in the hopper unit 76Y. A toner detecting sensor 82 including a piezoelectric element that detects whether the toner is in the hopper unit 76Y is fixed on an inner wall of the hopper unit 76Y. The pressing film 78Y made of a polyethylene terephthalate (PET) film or the like presses the Y toner with its rotation toward a detecting surface of the toner detecting sensor 82. This enables the toner detecting sensor 82 to successfully detect the toner in the hopper unit 76Y. A control of the rotational driving of the bottle unit of the toner bottle is performed in such a manner that the toner detecting sensor 82 can successfully detect the Y toner. Accordingly, as long as the bottle unit contains a sufficient amount of toner, a sufficient amount of Y toner is dropped from the bottle unit into the hopper unit 76Y through the holder unit 74Y to fill the hopper unit 76Y with the sufficient amount of toner. When this state is changed into a state where the Y toner is hardly detected by the toner detecting sensor 82 although the bottle unit is continually rotated, a control unit (not shown) regards that little Y toner remains in the bottle and gives an alarm indicating "toner near end" to the user.

A horizontal feed pipe 79Y is coupled to a lower portion of the hopper unit 76Y, and the Y toner in the hopper unit 76Y slides down a taper under its own weight and drops into the horizontal feed pipe 79Y. A toner supply screw 80Y is placed in the horizontal feed pipe 79Y to horizontally feed the Y toner along a longitudinal direction in the horizontal feed pipe 79Y with rotational driving of the screw.

A drop guide pipe 81Y in a position vertically extending is coupled to an end of the horizontal feed pipe 79Y in the longitudinal direction. A lower end of the drop guide pipe 81Y is coupled to a toner supply opening 17Y of the first developer containing chamber 9Y of the developing unit 7Y. When the toner supply screw 80Y of the horizontal feed pipe 79Y rotates, the Y toner fed to the end of the horizontal feed pipe 79Y in the longitudinal direction drops through the drop guide pipe 81Y and the toner supply opening 17Y into the first developer containing chamber 9Y of the developing unit 7Y.

In this way, the Y toner is supplied to the first developer containing chamber 9Y. The toner of other colors (C, M, and K) is supplied in the same manner.

Figure 11:
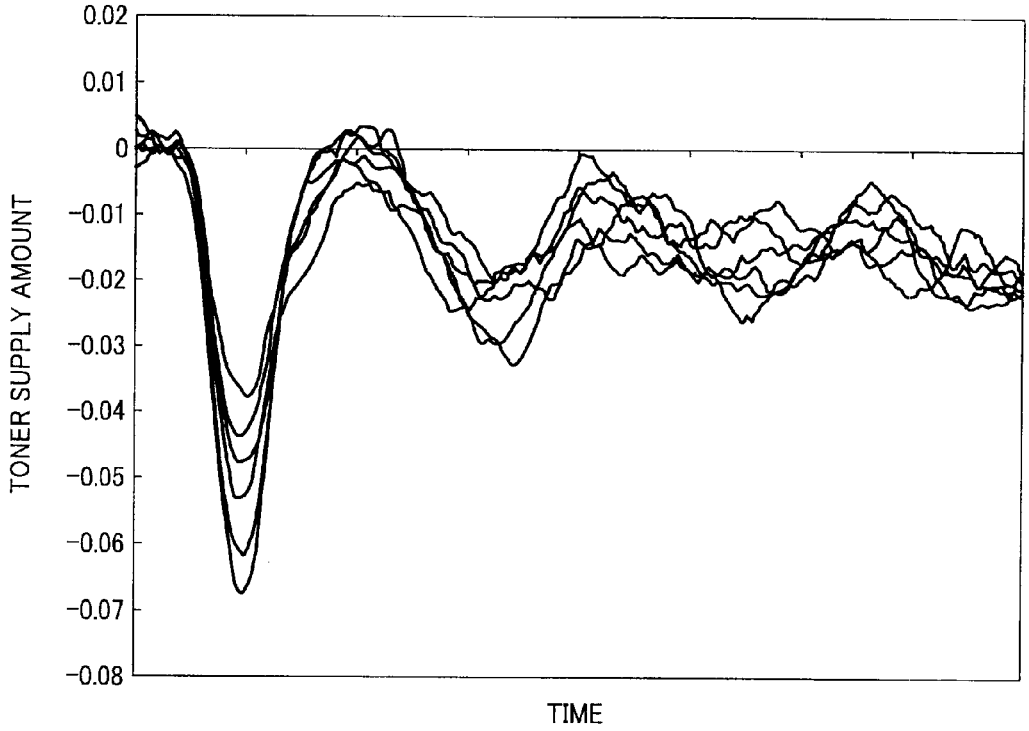
FIG. 11 is a graph of waveforms of toner supply amounts, which are obtained when the toner supply device of the printer repeatedly performs the same supply operations and are superimposed with respect to the operations.
Figure 12:
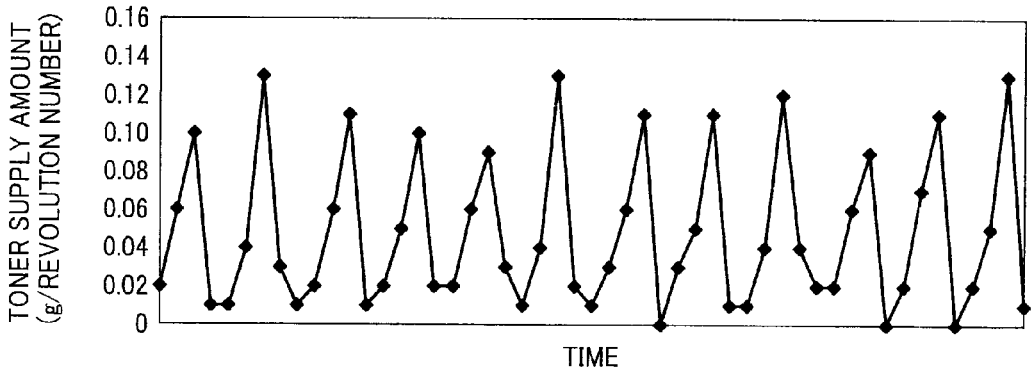
FIG. 12 is a graph of a relation between the number of revolutions of a toner feed screw in the toner supply device and a toner supply amount per revolution.

In this configuration that enables to supply the toner by rotational driving of the toner supply screw 80Y, a supply resolution is not so high. FIG. 11 is a graph of waveforms of toner supply amounts, which are obtained when the same supply operations are performed and superimposed with respect to the operations. FIG. 11 indicates that, even when the same supply operations are performed, the toner supply amount in each of the supply operations greatly fluctuates. The fluctuation of the supply amount becomes more noticeable when a time period of one supply operation is shorter. The supply amount sometimes fluctuates at certain intervals. For example, FIG. 12 is a graph of a relation between the number of revolutions of the toner supply screw 80Y and the toner supply amount per revolution. In this case, the supply amount temporarily increases greatly every four revolutions of the screw.

In the printer of the present embodiment, a lower limit B of a driving time of the toner supply device is set, and driving of the toner supply device is switched on and off under conditions that the driving time equal to or longer than the lower limit B is ensured. According to this supply, the fluctuation of the supply amount in each supply operation can be suppressed. A specific method for setting the lower limit B will be described in detail below.

In this printer, a driving speed of the toner supply device is set constant regardless of a required supply amount per unit time. The supply amount per unit time is adjusted according to the frequency of switching on and off of the driving. The frequency of switching on and off of the driving is set higher during a time period in which the required supply amount per unit is relatively large, while the frequency of switching on and off of the driving is set lower during a time period in which the required supply amount is relatively small. When images with high image area ratios are successively output under conditions that this switching control is performed, continuous driving during a rather long period may occurs as shown in an upper portion of FIG. 13. However, in the printer of the present embodiment, if the supply operation continues for a time period E, rolling of the toner may occur. The rolling is a phenomenon in which a larger amount of new toner is fed from the bottle unit to the hopper unit 76Y shown in FIG. 10, and a large amount of air is contained between toner particles, which greatly increases flowability of the toner, so that the toner automatically flows through the spiral space of the toner supply screw 80Y in the horizontal feed pipe 79Y under its own weight. When the rolling occurs, the toner is supplied automatically.

Figure 13:
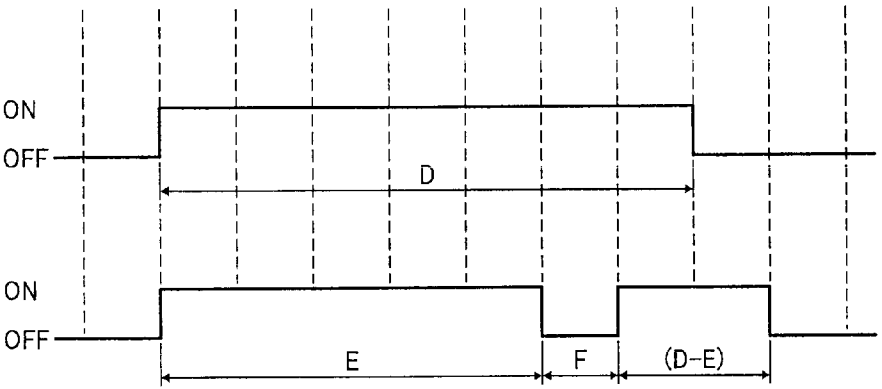
FIG. 13 is a timing chart for explaining an upper limit of a continuous driving time for the toner supply device.

Accordingly, in the printer of the present embodiment, the upper limit E of the driving time of the supply operation is set as shown at a lower portion in FIG. 13. When continuous driving beyond the upper limit E is expected, continuous driving during the upper limit E is performed, an interruption period F is then provided, and the remaining driving (the expected time D—the upper limit E) is then performed as shown in FIG. 13. In this way, the rolling of the toner can be prevented.

Figure 14:
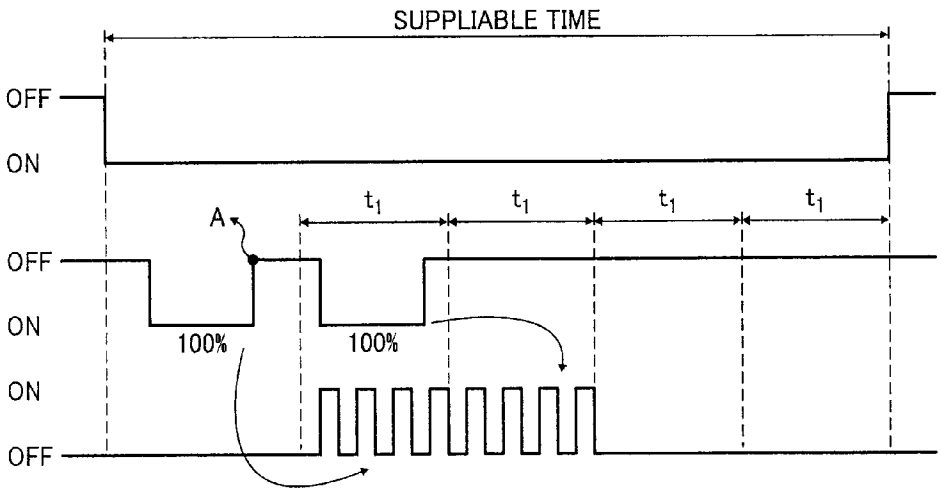
FIG. 14 is a timing chart for explaining a toner supply control in a conventional image forming apparatus.

A toner supply control in a conventional image forming apparatus is explained. FIG. 14 is a timing chart for explaining a toner supply control in a conventional image forming apparatus. In FIG. 14, $t_1$ denotes a time period required for output of a sheet of A4 recording paper. In the conventional toner supply control, an amount of toner consumption is estimated based on an image area ratio of an output image of a previous page (at a time point A), and then all of toner supply corresponding to the amount of toner consumption of the previous page is performed within an output time period for a subsequent page. Even when an image in entirely black (the image area ratio=100%) of a maximum number of output dots for the previous page is output on a sheet of A4 recording paper, toner supply corresponding to a large amount of toner consumption due to this output is performed in a lump at output of the subsequent page as shown in FIG. 14. However, fluctuation of the toner concentration resulting from the toner consumption due to the output of the previous page continues in the first developer containing chamber 9Y until outputs of subsequent several pages are performed. Accordingly, the conventional toner supply does not have supply amount fluctuation that enables to cancel the waveform of the toner concentration fluctuation occurring in the first developer containing chamber 9Y.

A characteristic configuration of the printer according to the present embodiment is explained.

A supply control unit 102 of the printer generates a driving control pattern for the toner supply device based on the image area ratio of each page to be output. At that time, the supply control unit 102 generates the pattern to obtain supply amount fluctuation that enables to negate the toner concentration fluctuation occurring with output of the page (toner concentration fluctuation expected to occur in the developer that has passed through the second developer containing chamber 14Y as a supply area). To generate these driving control patterns, a waveform of toner concentration fluctuation obtained when an entirely black image with an image area ratio of 100% is output (hereinafter, "reference consumption waveform") is practically measured by a toner concentration sensor in a prior experiment. A waveform having an opposite phase to that of the reference consumption waveform is a fluctuation waveform of the toner supply amount that enables to completely negate the toner concentration fluctuation due to the output of the entirely black image with the image area ratio of 100% (hereinafter, "reference canceling waveform"). When the entirely black image with the image area ratio of 100% is output, the toner concentration fluctuation resulting from the output can be completely canceled by supplying the toner with the same supply amount fluctuation as that of the reference canceling waveform. When the image area ratio is 80%, the toner concentration fluctuation can be canceled by supplying the toner with supply amount fluctuation having a waveform with the same phase as that of the reference canceling waveform and 80% of the amplitude of the reference canceling waveform. For this purpose, an active noise control (ANC) filter circuit is provided to convert the amplitude of the reference canceling waveform to be adapted to an image area ratio of an output image and obtain a canceling waveform corresponding to the image area ratio.

Figure 15:
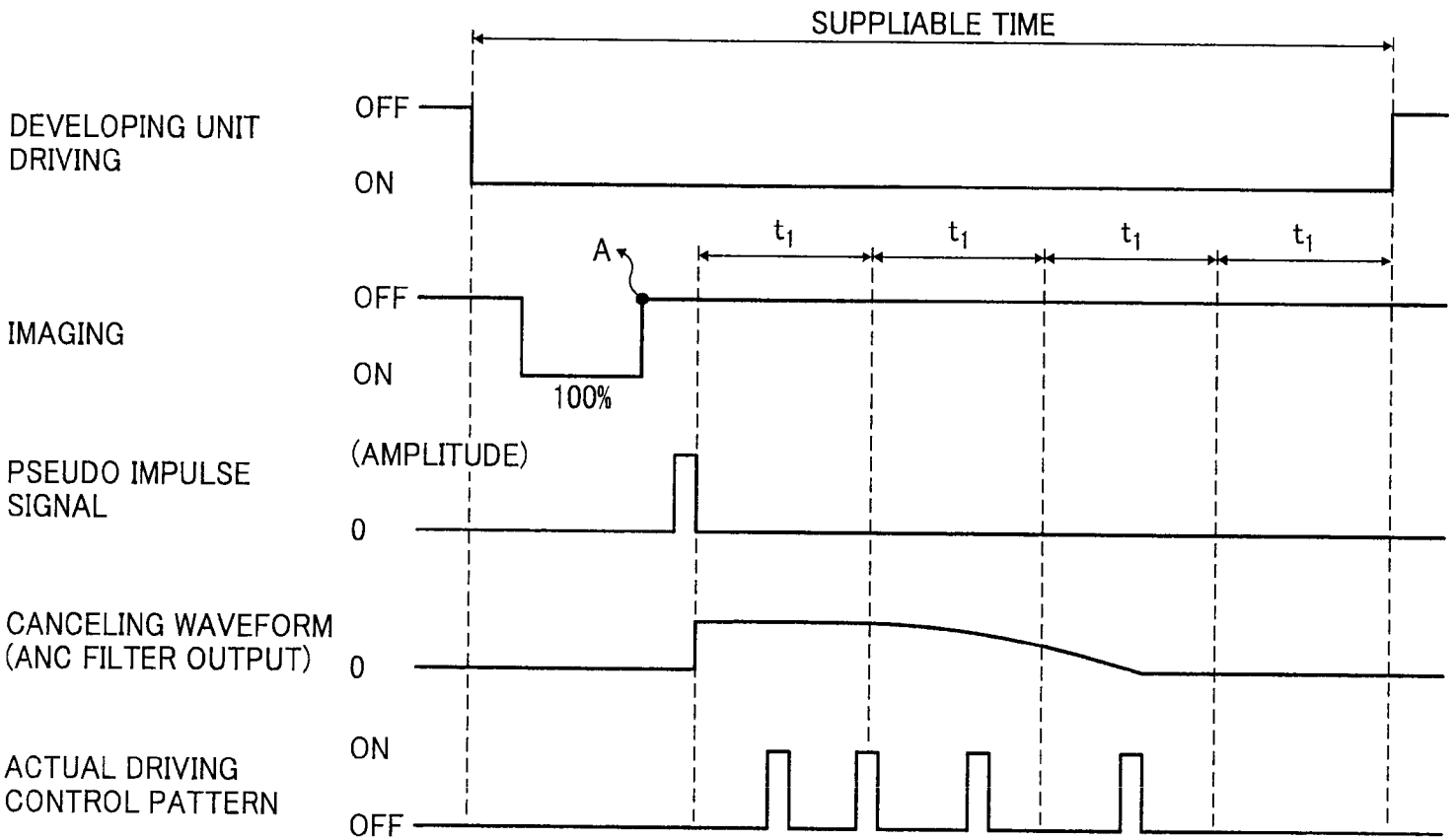
FIG. 15 is a timing chart for explaining a toner supply control in the printer according to the embodiment.
Figure 16:
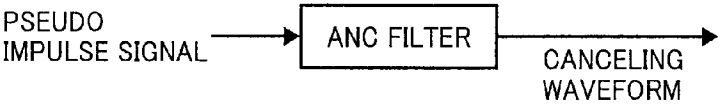
FIG. 16 is a partial block diagram of an ANC filter circuit.

FIG. 15 is a timing chart for explaining a toner supply control in the printer according to the present embodiment. Also in FIG. 15, $t_1$ denotes a time period required for output of a sheet of A4 recording paper. When recognizing an image area ratio in output of a previous page, the supply control unit 102 outputs a rectangular pseudo impulse signal that rises and falls in a quite short time. It is assumed that the pseudo impulse signal has an amplitude corresponding to the image area ratio. When the pseudo impulse signal is input to the ANC filter circuit, the ANC filter circuit (see FIG. 16) outputs a canceling waveform obtained by converting the reference canceling waveform to have an amplitude corresponding to the image area ratio. If the toner supply device with a high supply resolution is used, toner supply fluctuation that enables to completely cancel the toner concentration fluctuation can be generated by controlling driving of the toner soupy device according to the canceling waveform. However, because the toner supply device of the printer according to the present embodiment has not so high supply resolution as described above, the driving control directly corresponding to the canceling waveform cannot be performed. Therefore, the canceling waveform is integrated, and then a driving switching pattern for rising switching on and off of the driving once at a resultant integration value each time the integration value becomes equal to or larger than the lower limit B above described is obtained as a driving control pattern. This driving control pattern is continued for a plurality of pages from the subsequent page, as shown in FIG. 15.

Figure 17:
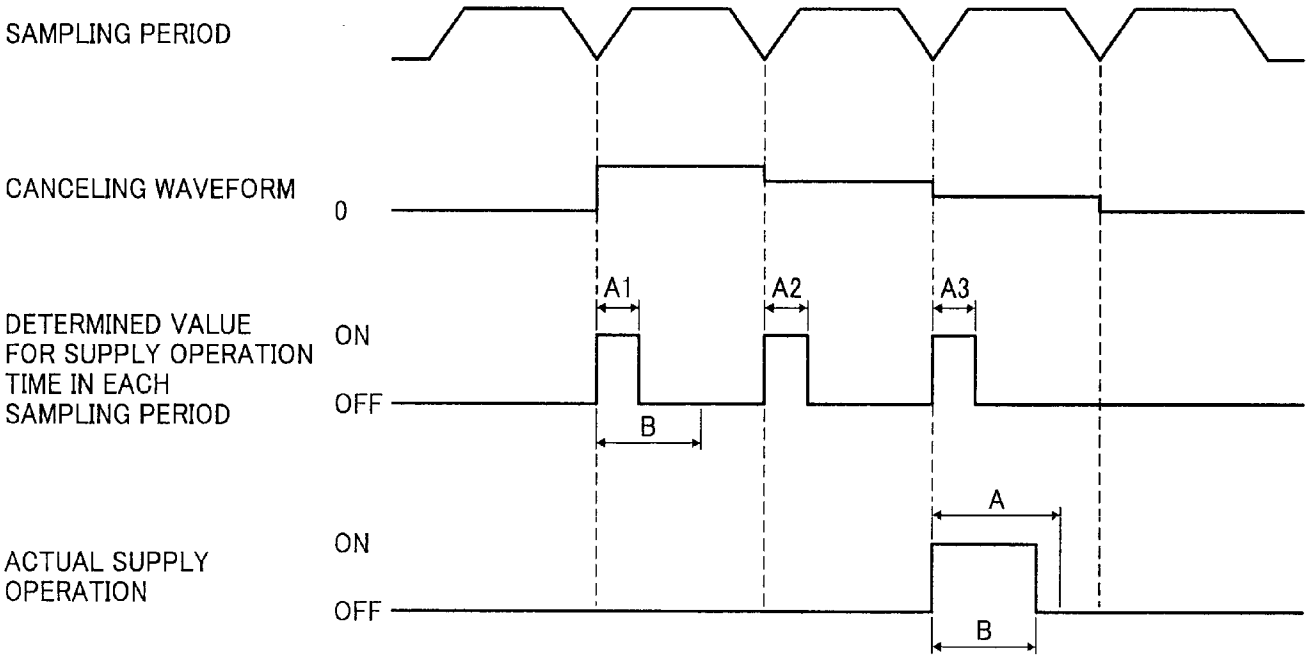
FIG. 17 is a timing chart for explaining a lower limit of a driving time of the toner supply device.

FIG. 17 is a timing chart for explaining the lower limit B of the driving time for the toner supply device. In FIG. 17, the supply control unit 102 obtains an output value Vt from the toner concentration sensor in a predetermined sampling period, and outputs a canceling waveform from the ANC filter circuit based on the obtained value. The supply control unit 102 successively determines a required supply operation time in each sampling period for the canceling waveform, and successively adds the determined values (A1, A2, and A3). Simultaneously, the supply control unit 102 compares an accumulation A of the determined values and the lower limit B with each other. The supply control unit 102 then generates a driving control pattern that enables to rise switching on and off of the driving of the toner supply device in the driving time equal to the lower limit B once at a point in time when the accumulation A becomes equal to or longer the lower limit B. Accordingly, the driving time equal to or longer than the lower limit B is ensured in each driving. When the rising of the switching on and off of the driving in the driving time equal to the lower limit B is determined, the supply control unit 102 changes the accumulation A into a difference between the accumulation A and the lower limit B, and then calculates an accumulation again. That is, the difference between the accumulation A and the lower limit B is carried over to the subsequent accumulation.

Figure 18:
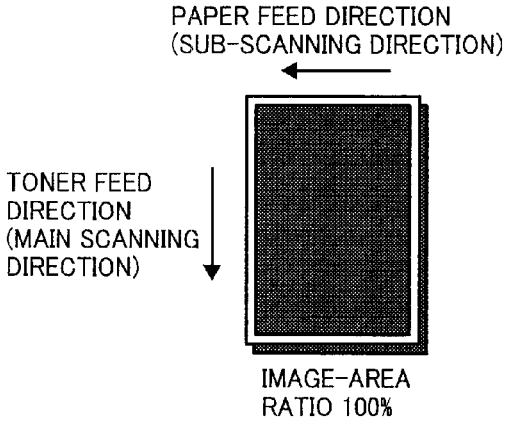
FIG. 18 is a schematic diagram of a sheet of A4 paper output entirely in black.
Figure 19:
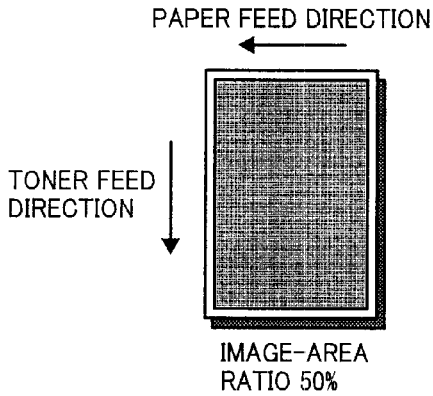
FIG. 19 is a schematic diagram of a sheet of A4 paper output entirely in 50% halftone.
Figure 20:
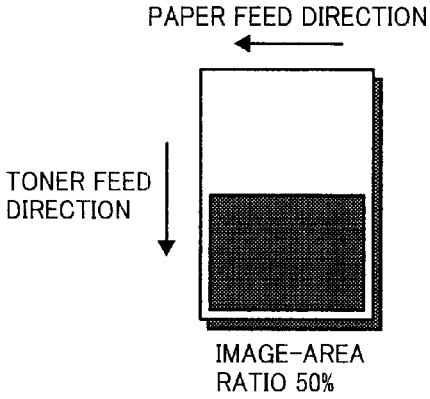
FIG. 20 is a schematic diagram of a sheet of A4 paper with an upstream half in a toner feed direction output entirely in black.
Figure 21:
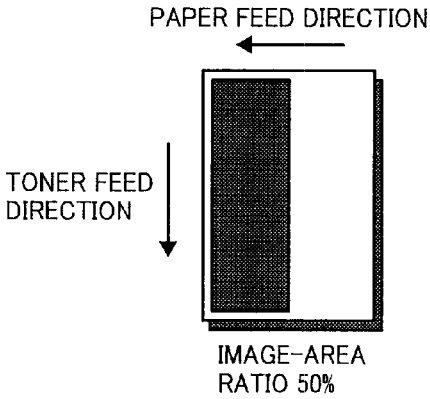
FIG. 21 is a schematic diagram of a sheet of A4 paper with an upstream half in a paper feed direction output entirely in black.

The reference consumption waveform for an A4 sheet, for example, is the one at output of the entirely black image (the image area ratio=100%) as shown in FIG. 18. When the image area ratio is less than 100%, it is assumed that an entirely halftone image as shown in FIG. 19 is output, regardless of pixel distribution on the paper. Specifically, the entirely halftone image as shown in FIG. 19 has an image area ratio of 50%. Examples of images with the image area ratio of 50% include a character image, a partially black image locally located in a partial area in the toner feed direction as shown in FIG. 20, and a partially black image locally located in a partial area in the paper feed direction as shown in FIG. 21, in addition to the entirely halftone image as shown in FIG. 19. All of the character image and the partially black images are regarded as the entirely halftone image as shown in FIG. 19.

Figure 22:
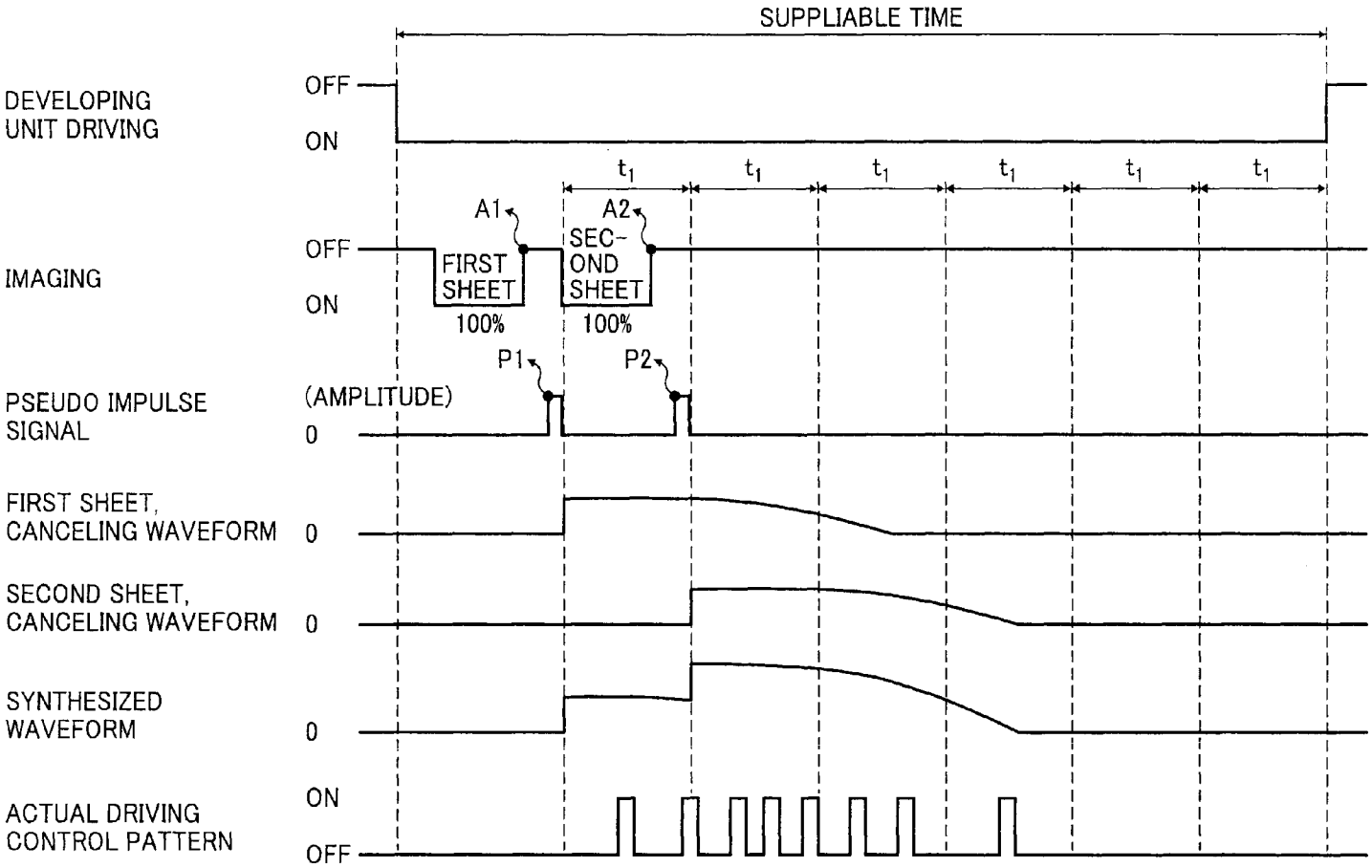
FIG. 22 is a timing chart for explaining a toner supply control in a successive image-forming operation.

FIG. 22 is a timing chart for explaining a toner supply control in a successive image-forming operation. In the successive image-forming operation, the supply control unit 102 outputs a canceling waveform that enables to cancel the toner concentration fluctuation expected to occur in the developer in the first developer containing chamber 9Y from the ANC filter circuit according to output of the pseudo impulse signal with an amplitude corresponding to the image area ratio of each page, and generates the driving control pattern corresponding to the canceling waveform. The supply control unit 102 synthesizes the driving control pattern generated based on the subsequent page and an unused portion of the driving control pattern, which is obtained by eliminating a portion already reflected on the driving control from the driving control pattern generated based on the image area ratio of the previous page, as shown in FIG. 22.

As shown in FIG. 22, when an image of one page is output, the toner concentration fluctuation due to the toner consumption resulting from the output of the image continues for a relatively long time in the first developer containing chamber 9Y. Therefore, the driving control pattern for each page is for controlling the toner supply device over a relatively long time. Accordingly, the driving control of the toner supply device for canceling the toner concentration fluctuation due to the output of the previous page needs to be performed until output of the subsequent page. The driving control pattern for each page is generated individually and successively, and the unused portion of the driving control pattern for the previous page and the driving control pattern for the subsequent page are successively synthesized while the driving of the toner supply device is controlled based on the synthesized driving control pattern. This control enables to fluctuate the toner supply amount to successively follow the toner concentration fluctuation occurring for a relatively long time due to output of each page, thereby supplying the toner of an amount corresponding to the toner concentration of the developer at the position of the toner supply opening.

Each of the driving control patterns is formed by arranging a plurality of rectangular pulse signals. When the driving control patterns are simply superimposed, the amplitude of the rectangular pulse signal is increased. In the printer of the present embodiment, however, the adjustment of the supply amount under the driving speed control is not performed but the driving speed is set constant, and thus such a control that increases the amplitude of the rectangular pulse signal cannot be performed. Accordingly, when overlap of the rectangular pulse signals occurs at the synthesis of the driving control pattern for the previous page and the driving control pattern for the subsequent page, the positions of the rectangular pulse signals are shifted to avoid the overlap.

Instead of successively synthesizing the driving control patterns for the subsequent pages with the unused portion of the driving control pattern of the previous page to control the driving of the toner supply device based on the synthesized driving control pattern, the ANC filter circuit can be configured as follows. That is, the ANC filter circuit can be configured to, when the pseudo impulse signal corresponding to the subsequent page is input, correct the subsequent output by synthesizing an un-output portion of the canceling waveform generated based on the pseudo impulse signal corresponding to the previous page with the canceling waveform based on the subsequent pseudo impulse signal. That is, the ANC filter circuit can be configured to output a synthesized waveform as shown in FIG. 22.

Figure 23:
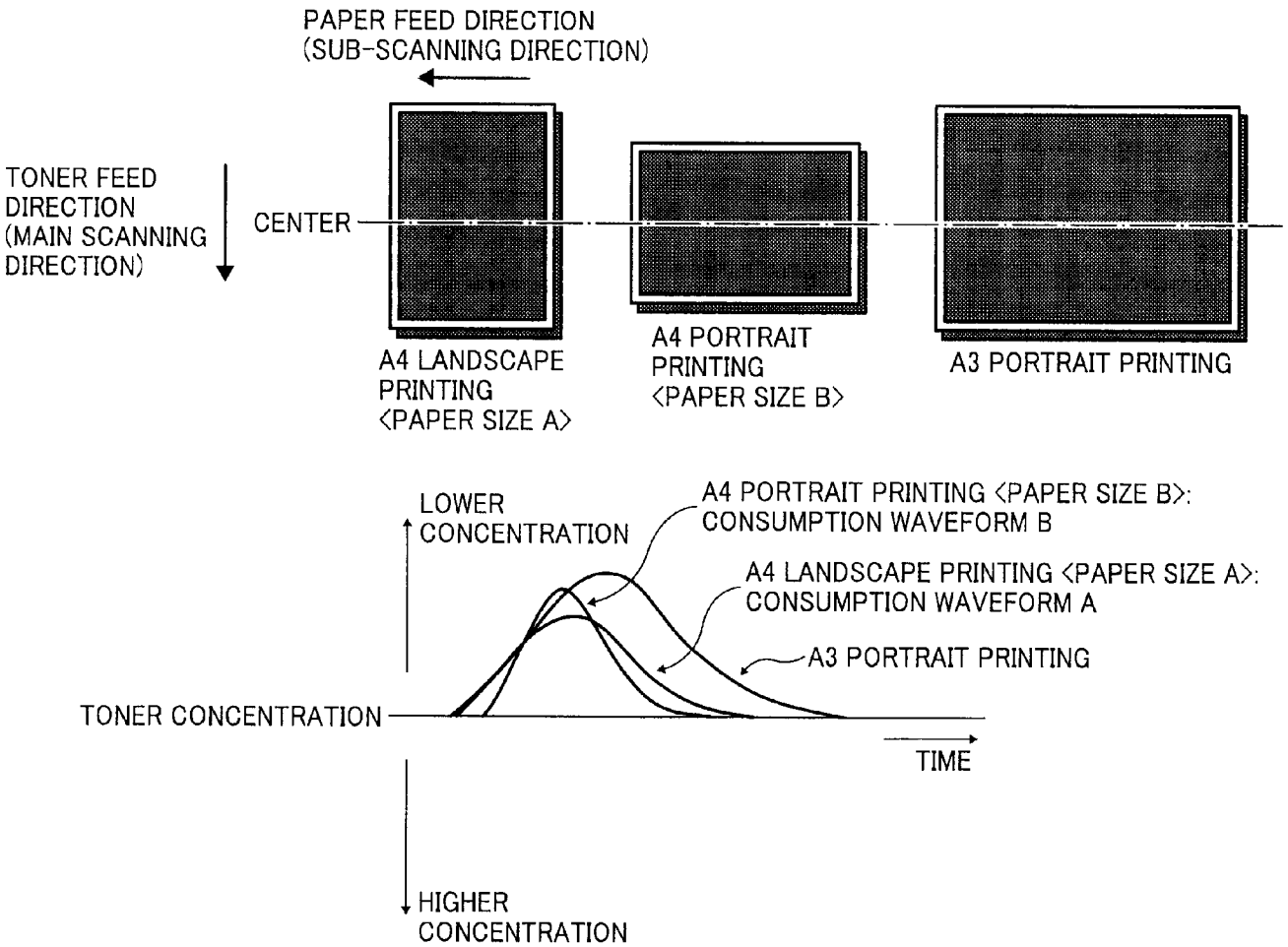
FIG. 23 is a schematic diagram of relations between sizes and feed directions of recording paper and waveforms of toner concentration fluctuation at output of entirely black images.
Figure 24:
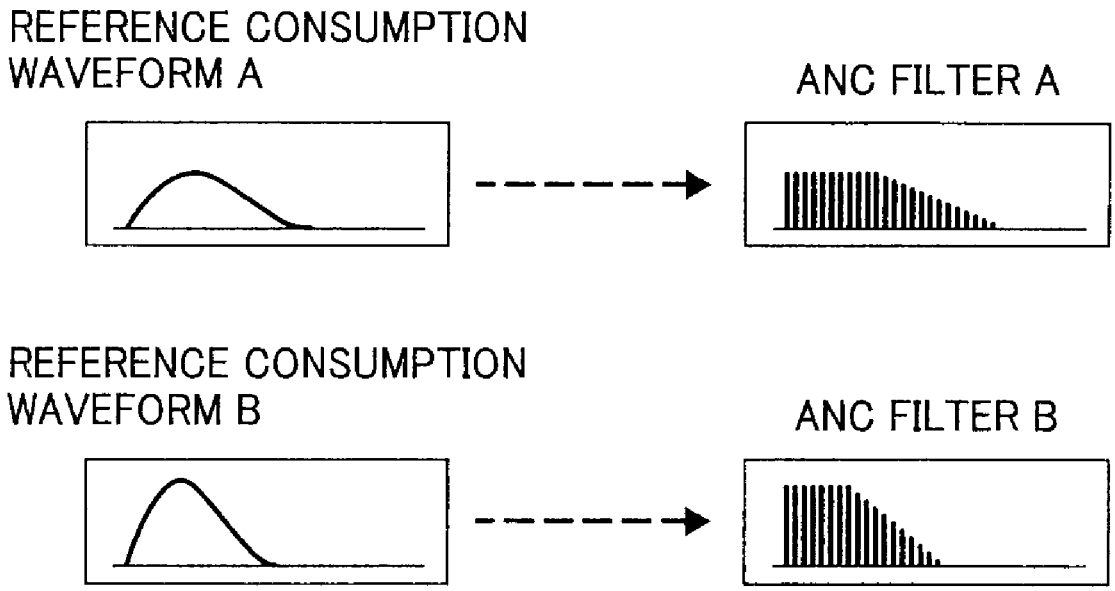
FIG. 24 is a schematic diagram of relations between different reference consumption waveforms and ANC filter circuits.

While the above descriptions assume that the size and feed direction of the recording paper to be used do not change, the size and feed direction of the recording paper change practically. For example, sheets of A4 recording paper are fed horizontally along the lateral direction in some timing while the sheets of A4 recording paper are fed vertically along the longitudinal direction or sheets of recording paper in different sizes are fed horizontally in other timing. FIG. 23 is a schematic diagram of relations between sizes and feed directions of the recording paper and waveforms of toner concentration fluctuation at output of entirely black images (the image area ratio=100%). As shown in FIG. 23, when an entirely black image with the image area ratio of 100% is output on recording paper with different sizes and feed directions, the waveforms of the toner concentration fluctuation become different. This indicates that the reference consumption waveforms differ according to the sizes and feed directions of the recording paper. Therefore, as shown in FIG. 24, different ANC filter circuits need to be used according to the sizes and feed directions of the recording paper.

Figure 25:
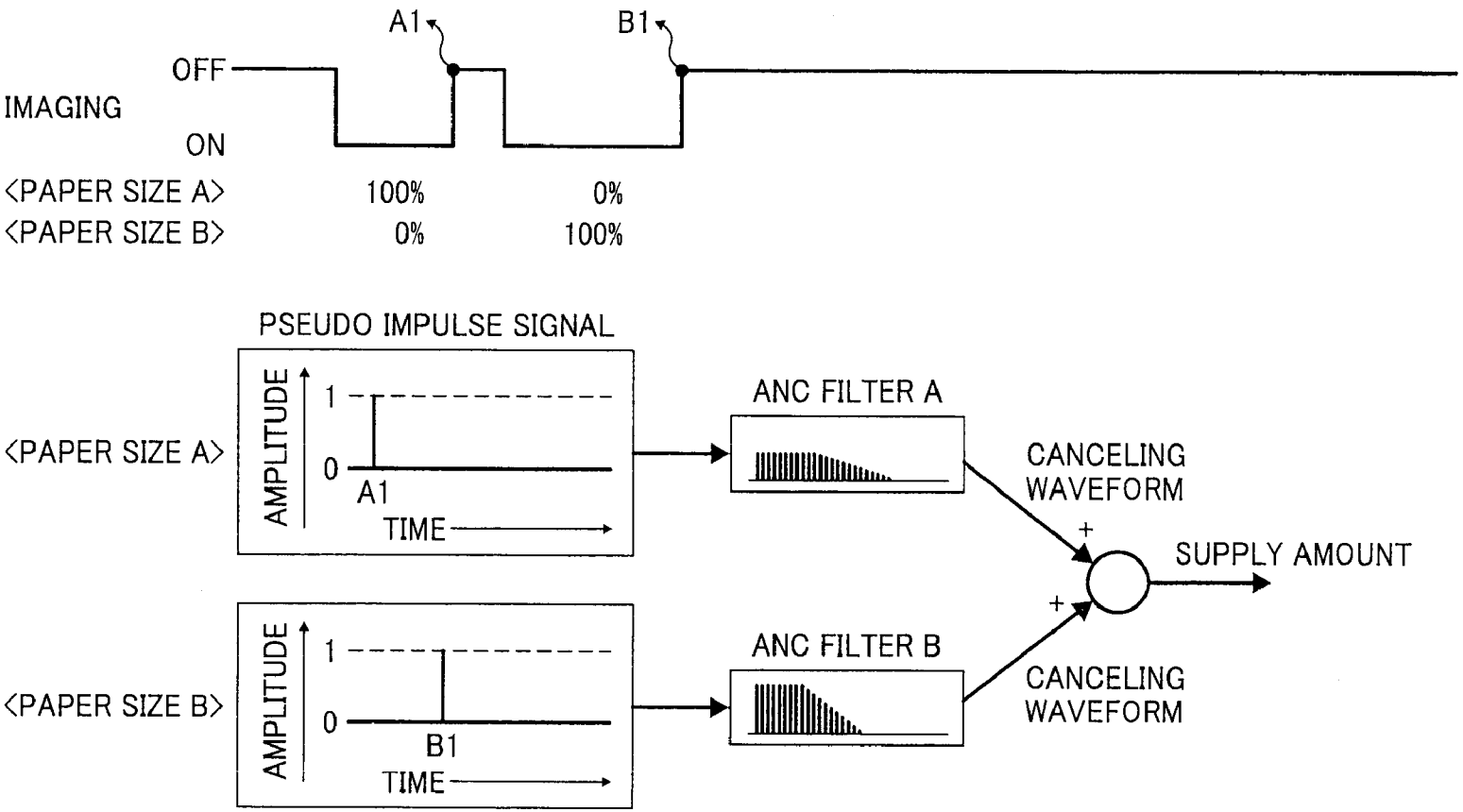
FIG. 25 is a circuit diagram for explaining input manners of a pseudo impulse signal when different sheets of recording paper are used for first and second times.
Figure 26:
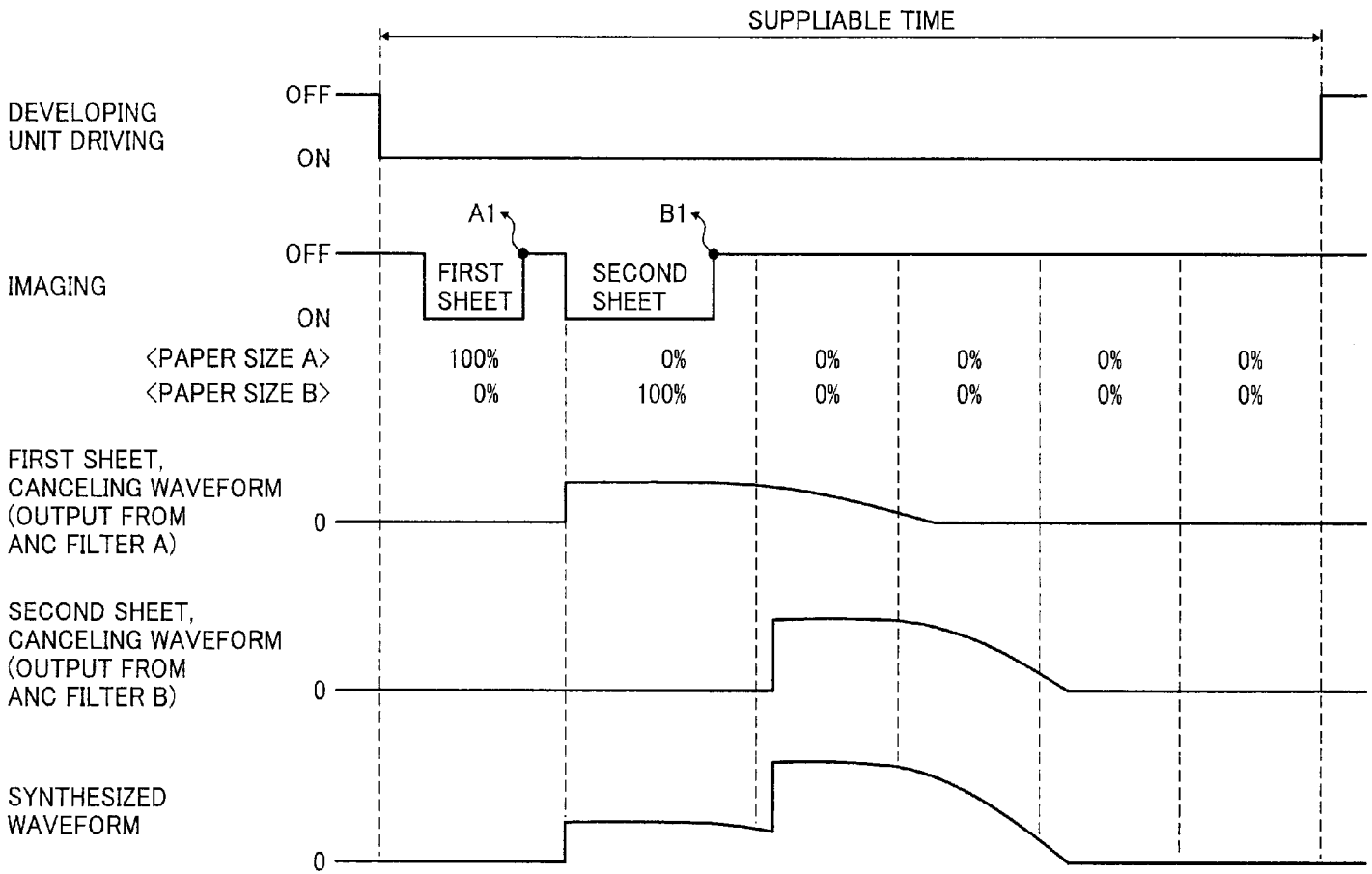
FIG. 26 is a timing chart for explaining a toner supply control when different sheets of recording paper are used for first and second times.

Accordingly, the printer of the present embodiment includes a plurality of ANC filter circuits corresponding to the sizes and feed directions for a plurality of fixed sizes. When the pseudo impulse signal corresponding to the image area ratio is generated at the output of each page, the signal is output to only one of the ANC filter circuits corresponding to the size and feed direction of the output page. When considering an example in which a sheet of a size A is output first and then a sheet of a size B is output secondly as different sizes, the pseudo impulse signal is output only to an ANC filter A at the output of the first page of the size A and the pseudo impulse signal is output only to an ANC filter B at the output of the second page of the size B, as shown in FIGS. 25 and 26. The output sides of the ANC filters are parallel-connected. That is, algorithm (ANC filter) corresponding to the size and feed direction of the paper is selected for each page to generate the driving control pattern.

Figure 27:
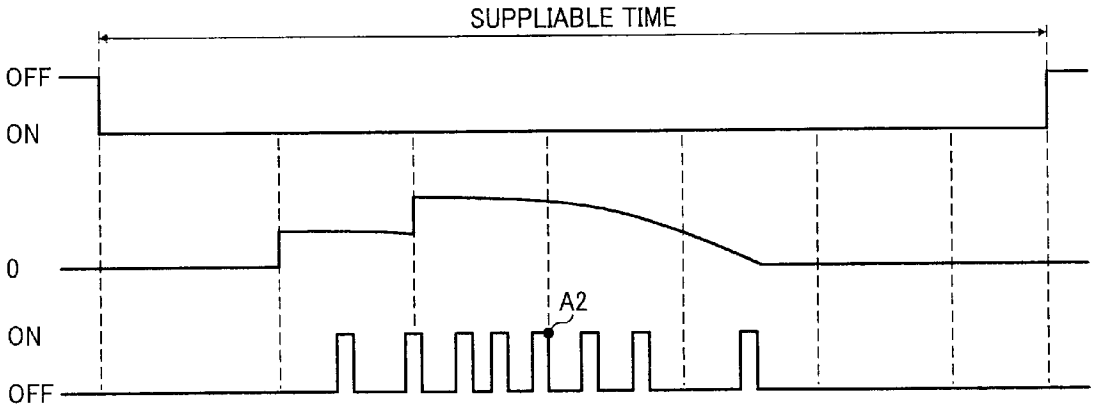
FIG. 27 is a timing chart for explaining a toner supply control in a latter half of a print job.
Figure 28:
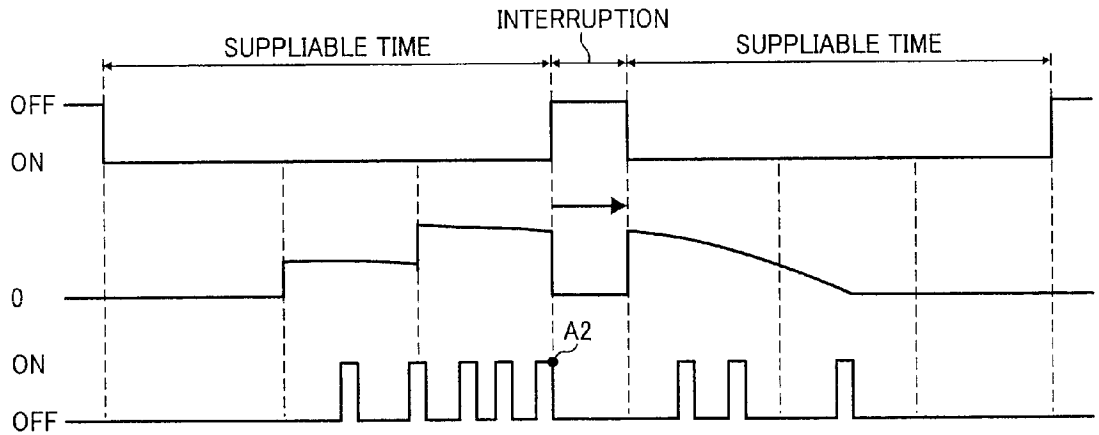
FIG. 28 is a timing chart for explaining a relation between a toner supply control at the end of a previous print job and a toner supply control at the start of a present print job.

After the last page is output in a successive image-forming operation or only one page is output in an image forming operation for one-sheet output, driving of the devices is stopped after an idling operation for a predetermined time is performed. It is desirable that all the driving control patterns for the toner supply device have been processed at that time. However, when the toner concentration fluctuation resulting from the toner consumption for the previous page extends over a considerable number of subsequent pages, there are some cases where not all of the driving control patterns can be processed. In these cases, if the idling operation is extended until all of the patterns are processed, a quick stop of the print job is hindered. On the other hand, an idling operation for a predetermined time is commonly set prior to the start of image formation at the start of a print job. Even when the driving of the devices is stopped with a portion of the driving control pattern remaining unused at the end of the print job, the remaining portion can be used during the idling operation at the start of another print job. Accordingly, in the printer of the present embodiment, the supply control unit 102 is configured to, when there is an unused portion of the driving control pattern at the end of a print job, store the unused portion of the pattern in a data storage unit, and control driving of the toner supply device based on the stored pattern portion at the start of the subsequent print job. It is assumed, for example, that a timing chart as shown in FIG. 27 is obtained when the whole of an expected driving control pattern is performed at the end of a print job. In this timing chart, a time point A2 is a proper print-job end timing. However, at the time point, the entire driving control pattern has not been processed yet. In this case, the print job is ended at the time point A2, and a portion of the driving control pattern after the time point A2 is stored in the data storage unit, as shown in FIG. 28. The stored portion of the driving control pattern is processed at the start of the subsequent print job.

When the output waveform from the ANC filter circuit is to be corrected so that the synthesized waveform shown in FIG. 22 is output from the ANC filter circuit, instead of correcting the driving control pattern when the output of the subsequent page occurs, an un-output portion of the waveform at the time point A2 is stored in the ANC filter circuit. Specifically, a job end signal is input to the ANC filter circuit at the end of the print job. Upon input of the job end signal, the output is temporarily stopped to store the un-output portion of the waveform in the ANC filter. A job start signal is then input to the ANC filter circuit when the subsequent print job command is issued and the print job is started, and the stored un-output portion of the waveform is output from the ANC filter with the input of the signal.

Figure 29:
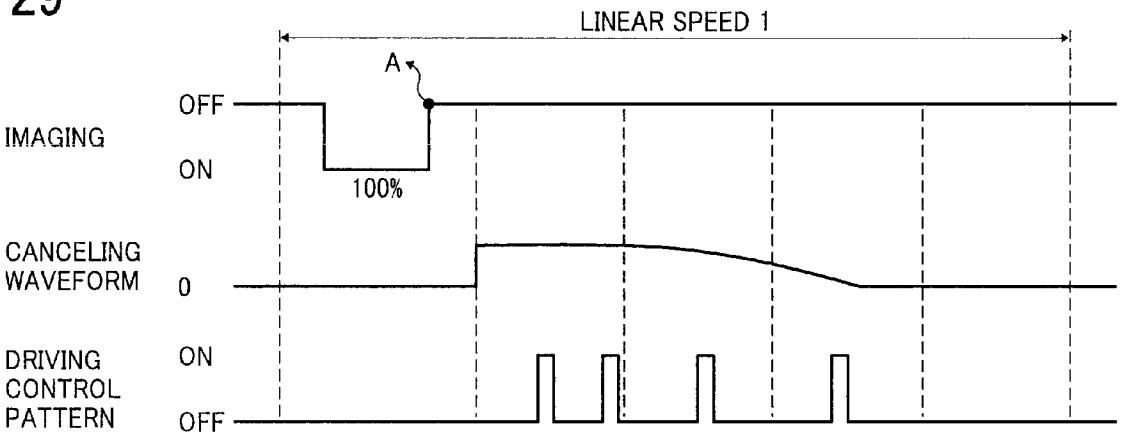
FIG. 29 is a timing chart for explaining a toner supply control when a print job is performed only with one linear speed from the start to the end of the job.
Figure 30:
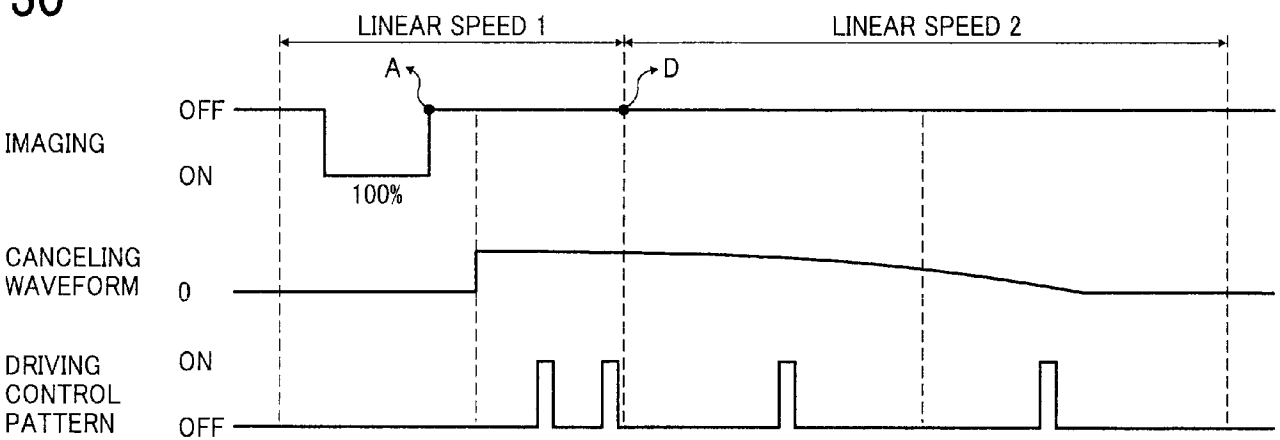
FIG. 30 is a timing chart for explaining a toner supply control when the linear speed is changed during the job.

The printer of the present embodiment can switch two print speed modes (high-speed print and low-speed print) according to commands from the user. When the print speeds, that is, process linear speeds are different, the revolution speeds of the feed screw in the developing unit become different, and thus different reference consumption waveforms and canceling waveforms are obtained. Further, the driving control patterns become different. A driving control pattern at one process linear speed can be converted into a driving control pattern at the other process linear speed based on a difference in the linear speed. It is assumed that a driving control pattern as shown in FIG. 29 is obtained in the low-speed print mode, for example, and that the print mode is switched into the high-speed print mode immediately after generation of this driving control pattern and before processing of the driving control pattern, for example. In this example, the generated driving control pattern needs to be corrected to obtain a pattern for the high-speed print mode and then processed. It is assumed here that the process linear speed in the high-speed print mode is 1.5 times higher than that in the low-speed print mode. In this example, the driving control pattern generated for the low-speed print mode can be corrected into that for the high-speed print mode by increasing distances between the positions of the rectangular pulse signals on a time axis in the driving control pattern for the low-speed print mode by 1.5 times, which is equal to the ratio in the linear speed therebetween, as shown in FIG. 30. When the print speed is switched in the middle, the supply control unit 102 corrects the positions of the rectangular pulse signals on the time axis according to the linear speed ratio with respect to the unprocessed portion of the driving control pattern. That is, the supply control unit 102 is configured to, when the driving speed of the developing unit is changed with change in the print speed mode, correct the driving control pattern according to a difference between the driving speeds before and after the change.

When the output waveform from the ANC filter circuit is to be corrected so that the synthesized waveform as shown in FIG. 22 is output from the ANC filter circuit, instead of correcting the driving control pattern when the output of the subsequent page occurs, the following procedure is performed. That is, the output waveform from the ANC filter circuit is corrected according to a difference in the driving linear speed.

Modifications of the printer according to the present embodiment are explained below. Configurations of the printers according to the modifications are the same as that of the above embodiment unless otherwise specified.

[First Modification]

Figure 31:
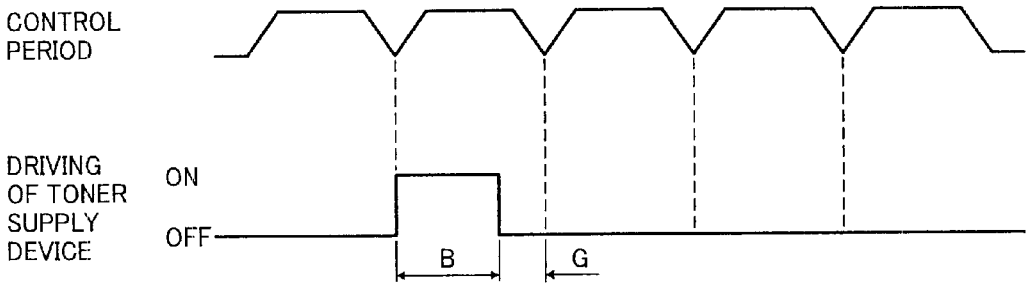
FIG. 31 is a graph for explaining a driving control unit of a printer according to a first modification of the embodiment.

A printer according to a first modification of the present embodiment is the same as that of the embodiment except for a point explained below. That is, a combination of the lower limit B of the driving time as described above and a stop time G subsequent thereto is regarded as one driving control unit, and driving of the toner supply device is switched on and off in this driving control unit, as shown in FIG. 31. Experiments have proven that, when the stop time G always follows the lower limit B, the rolling of the toner as described above never occurs no matter how long the driving control units are repeated. Therefore, the rolling of the toner can be avoided.

[Second Modification]

In the successive image-forming operation, the toner supply capacity of the toner supply device is changed when an average of the image area ratios of output images changes.

Figure 32:
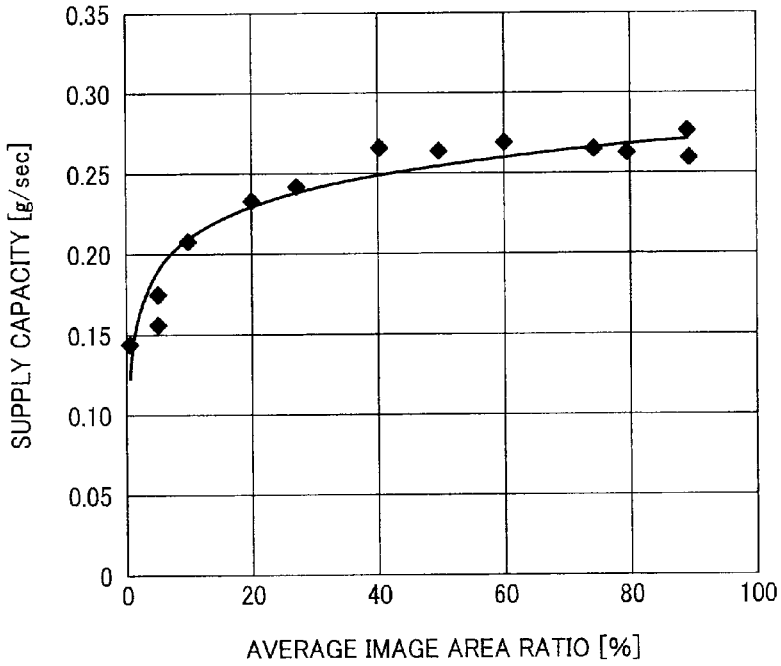
FIG. 32 is a graph for explaining a relation between toner supply capacities of the toner supply device in a successive image forming operation and average image area ratios.

FIG. 32 is a graph of a relation between the toner supply capacity of the toner supply device and the average image area ratio in the successive image-forming operation. The graph of FIG. 32 shows that the printer of the embodiment has a higher toner supply capacity when the average image area ratio in the successive image-forming operation is higher. These differences in the toner supply capacity are produced for a reason explained below. That is, when the average image area ratio is higher, a larger amount of toner is consumed. The amount of toner supply required to keep the toner concentration of the developer in the developing unit constant is increased accordingly. When the toner supply amount is increased, the number of times of driving of the toner supply device is increases, which shortens intervals between driving operations. A large amount of toner is thus supplied to the hopper unit 76Y shown in FIG. 10 in a short time, and accordingly the flowability of the toner in the hopper unit 76Y is increased. This causes the toner rolling to start. When the average area ratio is low, the flowability of the toner in the hopper unit 76Y is considerably reduced, and thus the toner supply amount per unit driving time becomes small. When the toner supply capacity is changed according to the average image area ratio in this way, it becomes hard to stabilize the toner concentration.

The printer according to the second modification obtains a moving average of the area ratios of output images and corrects the toner supply amount per unit image area ratio based on the obtained moving average in the successive image-forming operation.

Figure 33:
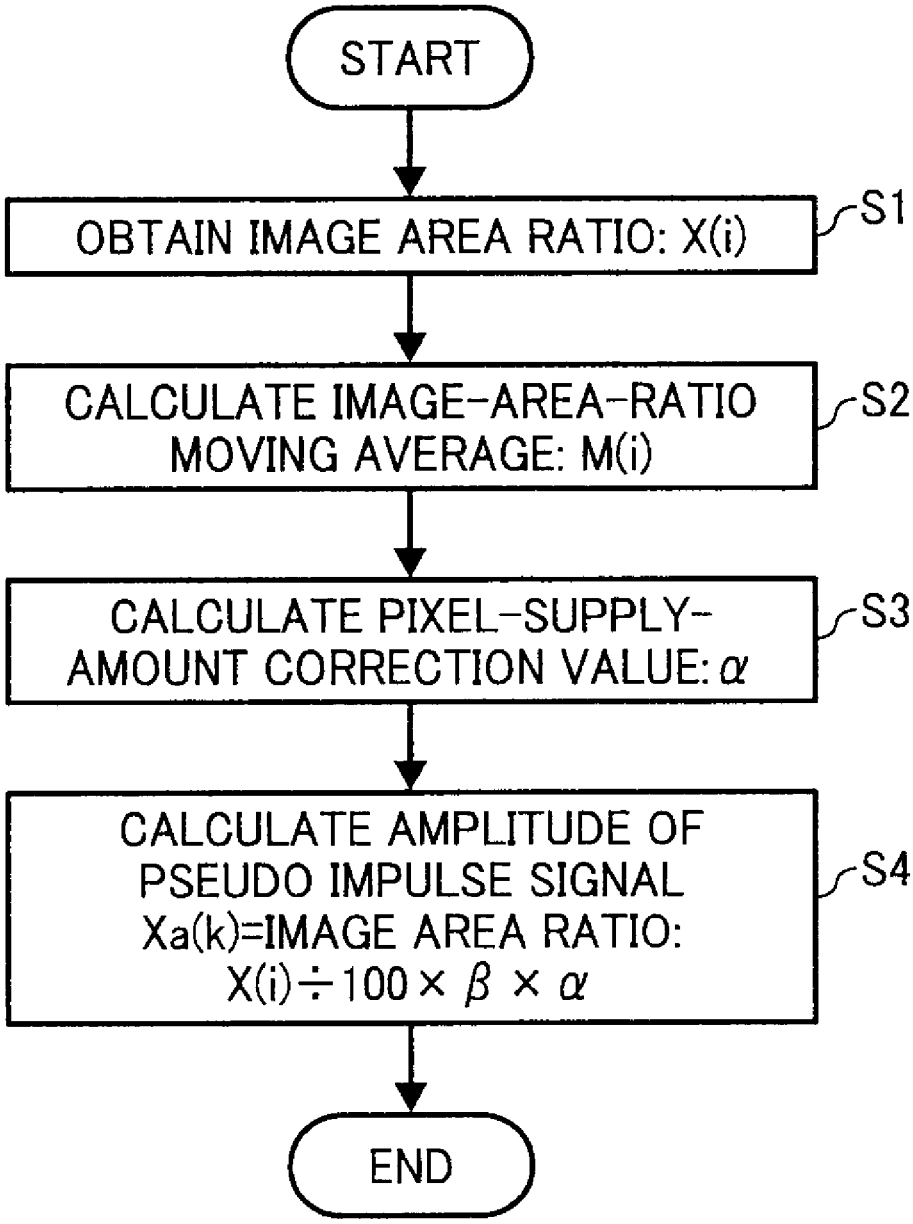
FIG. 33 is a flowchart of a toner-supply-amount correcting process performed by a supply control unit of a printer according to a second modification of the embodiment.

FIG. 33 is a flowchart of a toner-supply-amount correcting process performed by the supply control unit 102. The supply control unit 102 first obtains an image area ratio [%]: X(i) of an output image on a target page (Step S1). The supply control unit 102 then calculates a moving average of the image area ratios based on image area ratios of a predetermined number of pages previous to the target page, and the image area ratio X(i) of the target page (Step S2). For example, the supply control unit 102 calculates the moving average based on a formula "the moving average $M(i)=(M(i-1)\times(N-1)+X(i))/N$". In this formula, M(i) denotes a current moving average of the image area ratios, M(i−1) denotes a previous moving average of the image area ratios, and N denotes the number of accumulated sheets. Further, X(i) denotes an image area ratio [%] of the present page. In this formula, M(i) and X(i) are calculated individually for each color. The reason for using the moving average is to obtain a history of the image area ratios of output images. For example, when the moving average of the image area ratios is high, it implies that images with high image area ratios are successively output, and thus the toner supply capacity is increased.

A correction factor α corresponding to the moving average of the image area ratios is then determined by referring to a data table for determining a correction factor previously stored in a data storage unit (Step S3). Table 1 shown below is an example of the data table.

TABLE 1

| Cumulative average of image area ratios [%: equal to or lower than] | Correction factor α |
|---|---|
| 5 | 1.20 |
| 10 | 1.10 |
| 15 | 1.00 |
| 20 | 1.00 |
| 30 | 0.95 |
| 40 | 0.90 |

TABLE 1-continued

| Cumulative average of image area ratios [%: equal to or lower than] | Correction factor α |
|---|---|
| 50 | 0.86 |
| 60 | 0.85 |
| 70 | 0.85 |
| 80 | 0.85 |
| 90 | 0.80 |
| 100 | 0.80 |

A smaller correction factor α is selected for a higher moving average in considering that the toner supply capacity of the toner supply device is increased when the moving average of the image area ratios becomes higher. A data table such as Table 2 or 3 below can be used for example, as long as it enables to select a smaller correction factor α for a higher moving average.

TABLE 2

| Cumulative average of image area ratios [%: equal to or lower than] | Correction factor α |
|---|---|
| 5 | 1.00 |
| 10 | 1.00 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 0.90 |
| 100 | 0.80 |

TABLE 3

| Cumulative average of image area ratios [%: equal to or lower than] | Correction factor α |
|---|---|
| 5 | 1.20 |
| 10 | 1.10 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 1.00 |
| 100 | 1.00 |

An amplitude (height) of the pseudo impulse signal: Xa(k) is then calculated (Step S4). A formula "the amplitude:Xa (k)= the image area ratio $X(i)/100\times\beta\times\alpha$" is used here. In this formula, β denotes an amplitude when the image area ratio X(i) is 100%, and α denotes the correction factor. When the characteristics of the colors K, C, M, and Y shown in FIG. 32 are different, the correction factor α for each color is individually calculated. In this case, a formula "the amplitude:Xa (k)=the image area ratio $X(i)/100\times\beta\times\alpha\times$ the color correction factor" can be used.

As a specific example of the values, when images with the image area ratio 80% are output successively, the moving average of the image area ratios is 80%. The correction factor α is then determined as 0.85 based on the data table of Table 1. When the amplitude β is 1 when the image area ratio X(i) is 100%, the amplitude Xa of the pseudo impulse signal is calculated as 0.68 by calculation of "the amplitude Xa(k) of the pseudo impulse signal=0.8×1×0.85". The toner supply amount per unit image area ratio is corrected by adopting this amplitude Xa. In this way, an inappropriate toner supply amount resulting from a change of the toner supply capacity due to a change in the average image area ratio can be avoided.

[Third Modification]

In a printer according to a third modification of the embodiment, color images are developed by a revolver developing device. Specifically, the printer according to the third modification includes a revolver developing device in the form of a drum placed in a position having its axis line direction along a horizontal direction. This revolver developing device holds the K, C, M, and Y developing units within a rotation support, and moves the developing unit of a different color to a position facing a photoconductor each time the rotation support is rotated 90 degrees. K, C, M, and Y latent images successively formed on the photoconductor by switching the developing units according to the rotational angle of the rotation support of the revolver developing device are successively developed to obtain K, C, M, and Y toner images. The K, C, M, and Y toner images are transferred on an intermediate transfer, with one superimposed on top of another.

The revolver developing units removably hold K, C, M, and Y toner cartridges, and with rotation of the rotation support about its rotation axis, cause the toner cartridges to revolve about the rotation axis. Toner is discharged from the toner cartridges by using the revolutions, and stored in a toner temporary storage. The toner is supplied from the toner temporary storage to the developing units by rotational driving of a rotating member. With this configuration, when the revolver developing continues development of a predetermined color for a long time while stopping at a predetermined rotational angular position, an amount of toner of the color stored in the toner temporary storage is gradually reduced. When one-colored images with a high image area ratio are then successively printed, an amount of toner supply from the toner temporary storage to the developing unit becomes larger than an amount of toner supply from the toner cartridge to the toner temporary storage caused by revolution of the revolver developing device. Accordingly, a space is generated in the toner temporary storage. When a bulk density of the toner in the toner temporary storage is reduced in this way, an amount of toner supply per unit time is reduced. That is, the toner supply capacity of the toner supply device becomes lower when the average image area ratio becomes higher.

Table 4 is an example of a data table for determining a correction factor in the printer according to the third modification.

TABLE 4

| Cumulative average of image area ratios [%: equal to or lower than] | Correction factor α |
|---|---|
| 5 | 0.80 |
| 10 | 0.85 |
| 15 | 0.90 |
| 20 | 1.00 |
| 30 | 1.05 |
| 40 | 1.10 |
| 50 | 1.12 |
| 60 | 1.15 |
| 70 | 1.18 |
| 80 | 1.20 |
| 90 | 1.20 |
| 100 | 1.20 |

A larger correction factor α is selected for a higher moving average in considering that the toner supply capacity of the toner supply device is reduced when the moving average of the image area ratios is increased. A data table such as Table 5 or 6 below can be used as long as the table enables to select a larger correction factor α for a higher moving average.

TABLE 5

| Cumulative average of image area ratios [%: equal to or lower than] | Correction factor α |
|---|---|
| 5 | 1.00 |
| 10 | 1.00 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 1.10 |
| 100 | 1.20 |

TABLE 6

| Cumulative average of image area ratios [%: equal to or lower than] | Correction factor αf |
|---|---|
| 5 | 0.80 |
| 10 | 0.90 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 1.00 |
| 100 | 1.00 |

In the present invention, the driving control pattern for the toner supplying unit which is a pattern of the toner supply amount fluctuation canceling the toner concentration fluctuation expected to occur in the developer that has passed through the supply area to the developer carrying member in the circulation path of the developer is generated based on the image information of an output image. Normally, as described above, when an image of one page is output, toner concentration fluctuation resulting from toner consumption due to the output of the image continues for a relatively long time in a non-supply area of the circulation path. Therefore, the driving control pattern is generated to control the driving of the toner supplying unit for a relatively long time. In a successive image-forming operation, the driving control for the toner supplying unit for canceling the toner concentration fluctuation resulting from output of a previous page needs to be performed even until output of a subsequent page. Accordingly, the driving control pattern based on the image information of each page is generated individually and successively, and an unused portion of the driving control pattern generated based on the image information of a previous page is successively synthesized with a driving control pattern for a subsequent page, thereby controlling the driving of the toner supplying unit based on a synthesized driving control pattern. Alternatively, the pattern of the toner supply amount fluctuation generated based on the image information of the previous page is converted into the driving control pattern to be used for the driving control of the toner supplying unit, and the pattern of toner supply amount fluctuation generated based on the subsequent image information is synthesized with a portion of the toner-supply-amount fluctuation pattern of the previous page unconverted into the driving control pattern. A synthesized toner supply fluctuation pattern is then converted into the driving control pattern to be used for the driving control of the toner supplying unit. By this control, the toner supply amount can be fluctuated to successively follow the toner concentration fluctuation occurring for a relatively long time due to output of each page, and an amount of toner corresponding to the toner concentration of the developer at the position of the toner supply opening can be supplied. Therefore, the toner concentration can be stabilized more than the conventional technique.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent-image carrying member on which a latent image is formed;

an image-information obtaining unit that obtains image information;

a latent-image forming unit that forms the latent image on the latent-image carrying member based on the image information;

a developing unit that develops the latent image by causing a toner to adhere to the latent image on the latent-image carrying member in a development area, which is an area in which a developer carrying member and the latent-image carrying member face with each other, by conveying a developer, which contains the toner and a carrier, included in a supply area that is an area facing the developer carrying member in a predetermined circulation path to the development area, by carrying the developer on a moving surface of the developer carrying member while conveying the developer along the circulation path, and returns the developer used for the development in the development area to the supply area with a surface movement of the developer carrying member;

a toner supplying unit that supplies the toner to a non-supply area that is an area different from the supply area in the circulation path through a toner supply opening provided at a predetermined position in the non-supply area; and a control unit that controls an amount of supplying the toner by controlling driving of the toner supplying unit based on the image information, wherein the control unit is configured to, in a successive image-forming operation in which driving control patterns for the toner supplying unit that are patterns of toner supply amount fluctuation canceling toner concentration fluctuation expected to occur in the developer that has passed through the supply area are generated based on the image information, driving of the toner supplying unit is controlled based on the driving control patterns, and image forming operations for plural pages are successively performed, perform a process of:

successively generating the driving control pattern for each of the pages based on the image information, and synthesizing an unused portion of the driving control pattern generated based on the image information of a previous page, that is obtained by eliminating a portion already reflected on the driving control for the toner supplying unit from the driving control pattern generated based on the previous page, with a driving control pattern generated based on a subsequent page, or, in the successive image-forming operation, perform a process of:

converting the toner-supply-amount fluctuation pattern generated based on the image information of the previous page into the driving control pattern to be used for the driving control of the toner supplying unit, synthesizing a portion of the toner-supply-amount fluctuation pattern of the previous page unconverted into the driving control pattern with the toner-supply-amount fluctuation pattern generated based on the subsequent image information, and converting a synthesized toner-supply-amount fluctuation pattern into the driving control pattern to be used for the driving control of the toner supplying unit.

2. The image forming apparatus according to claim 1, wherein, in the successive image-forming operation, the control unit is configured to generate the driving control pattern or the toner-supply-amount fluctuation pattern by selecting algorithm corresponding to a size and a feed direction of a sheet of each page.

3. The image forming apparatus according to claim 1, wherein the control unit is configured to, when there is an unused portion of the driving control pattern or a portion of the toner-supply-amount fluctuation pattern unconverted into the driving control pattern when the driving of the developing unit is to be stopped, store the unused portion of the pattern or the unconverted portion of the pattern in a data storage unit, and perform the driving control of the toner supplying unit based on the unused portion of the pattern or perform the driving control of the toner supplying unit based on the driving control pattern that is obtained by converting the unconverted portion of the pattern into driving control pattern, at resume of the driving of the developing unit.

4. The image forming apparatus according to claim 1, wherein the control unit is configured to, when a driving speed of the developing unit is changed during the driving control of the toner supplying unit, correct the driving control pattern or the toner-supply-amount fluctuation pattern based on a difference between driving speeds before and after the change.

5. The image forming apparatus according to claim 1, wherein the control unit is configured to set a lower limit of a driving time from start to end of the driving of the toner supplying unit, and generate the driving control pattern for switching on and off the driving of the toner supplying unit under a condition that the driving time equal to or longer than the lower limit is ensured.

6. The image forming apparatus according to claim 1, wherein the control unit is configured to set a pattern for stopping the toner supplying unit for a predetermined time before or after driving of the toner supplying unit for a predetermined time as a unit of the driving control, and generate the driving control pattern for switching on and off the driving of the toner supplying unit in the driving control unit.

7. The image forming apparatus according to claim 1, wherein the control unit is configured to suspend the driving of the toner supplying unit when a continuous driving time of the toner supplying unit reaches a predetermined value, and then control the driving of the toner supplying unit at resume of the driving according to a pattern that is obtained by synthesizing a portion of the driving control pattern corresponding to the suspension of the driving with a portion of the driving control pattern corresponding to a period after the suspension of the driving.

8. The image forming apparatus according to claim 1, wherein the control unit is configured to obtain a moving average of area ratios of output images based on the image information, and correct a toner supply amount per unit image area ratio based on the obtained moving average.

9. The image forming apparatus according to claim 8, wherein the control unit is configured to perform a correction to reduce the toner supply amount per unit image area ratio when the moving average is equal to or higher than a predetermined value, and increase the toner supply amount per unit image area ratio when the moving average is lower than the predetermined value.

10. The image forming apparatus according to claim 8, wherein the control unit is configured to perform a correction to increase the toner supply amount per unit image area ratio when the moving average is equal to or higher than a predetermined value, and increase the toner supply amount per unit image area ratio when the moving average is lower than the predetermined value.

* * * * *